US012611020B2

(12) United States Patent
Oh et al.

(10) Patent No.: US 12,611,020 B2
(45) Date of Patent: Apr. 28, 2026

(54) HAIR DRYER

(71) Applicant: LG ELECTRONICS INC., Seoul (KR)

(72) Inventors: Hyunjoo Oh, Seoul (KR); Kyungseok Min, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 531 days.

(21) Appl. No.: 18/274,095

(22) PCT Filed: Jan. 25, 2022

(86) PCT No.: PCT/KR2022/001287

§ 371 (c)(1),
(2) Date: Jul. 25, 2023

(87) PCT Pub. No.: WO2022/158939

PCT Pub. Date: Jul. 28, 2022

(65) Prior Publication Data

US 2024/0407523 A1 Dec. 12, 2024

(30) Foreign Application Priority Data

Jan. 25, 2021 (KR) ..... 10-2021-0010024

(51) Int. Cl.
*A45D 20/12* (2006.01)

(52) U.S. Cl.
CPC ..... *A45D 20/122* (2013.01)

(58) Field of Classification Search
CPC ..... A45D 20/122; A45D 20/12
See application file for complete search history.

(56) References Cited

U.S. PATENT DOCUMENTS

2017/0006991 A1* 1/2017 Stephens ..... A45D 20/122

FOREIGN PATENT DOCUMENTS

KR 10-2014-0017453 A 2/2014
KR 10-2018-0030620 A 3/2018

* cited by examiner

*Primary Examiner* — Jessica Yuen
(74) *Attorney, Agent, or Firm* — Birch, Stewart, Kolasch & Birch, LLP

(57) ABSTRACT

A hair dryer may comprise a concentrator coupled to a main body part. The concentrator can include a nozzle passage, which is formed between the inner peripheral surface of a nozzle part and the outer peripheral surface of a passage-forming auxiliary part to guide, to the outside, gas provided from a gas discharge part of the main body part. A nozzle coupling part and an auxiliary coupling part are provided on the nozzle passage to space a passage-forming part including the nozzle part from the passage-forming auxiliary part, and can fix the passage-forming part and the passage-forming auxiliary part. Therefore, the concentrator can be easily coupled to the hair dryer. In addition, the gas can be stably supplied to a user through the concentrator. That is, user convenience can be increased.

20 Claims, 24 Drawing Sheets

【Fig.1】
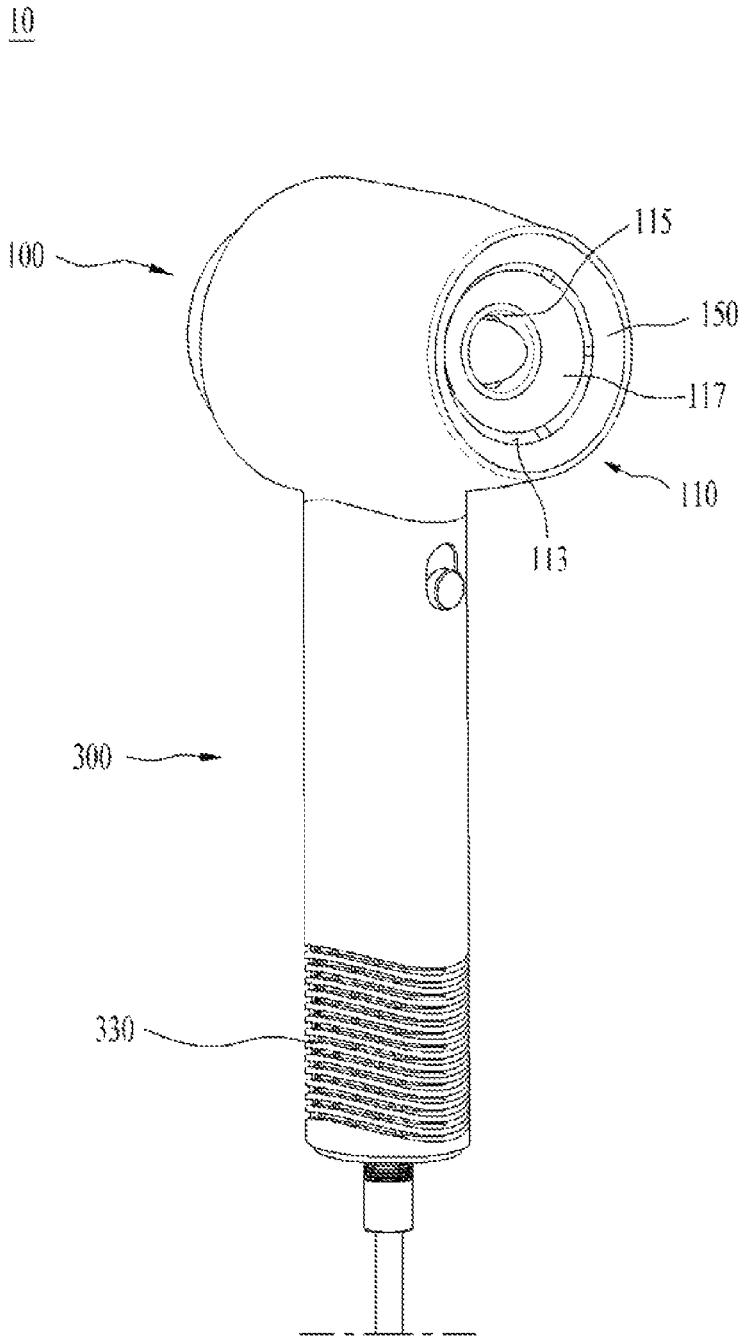

【Fig.2】
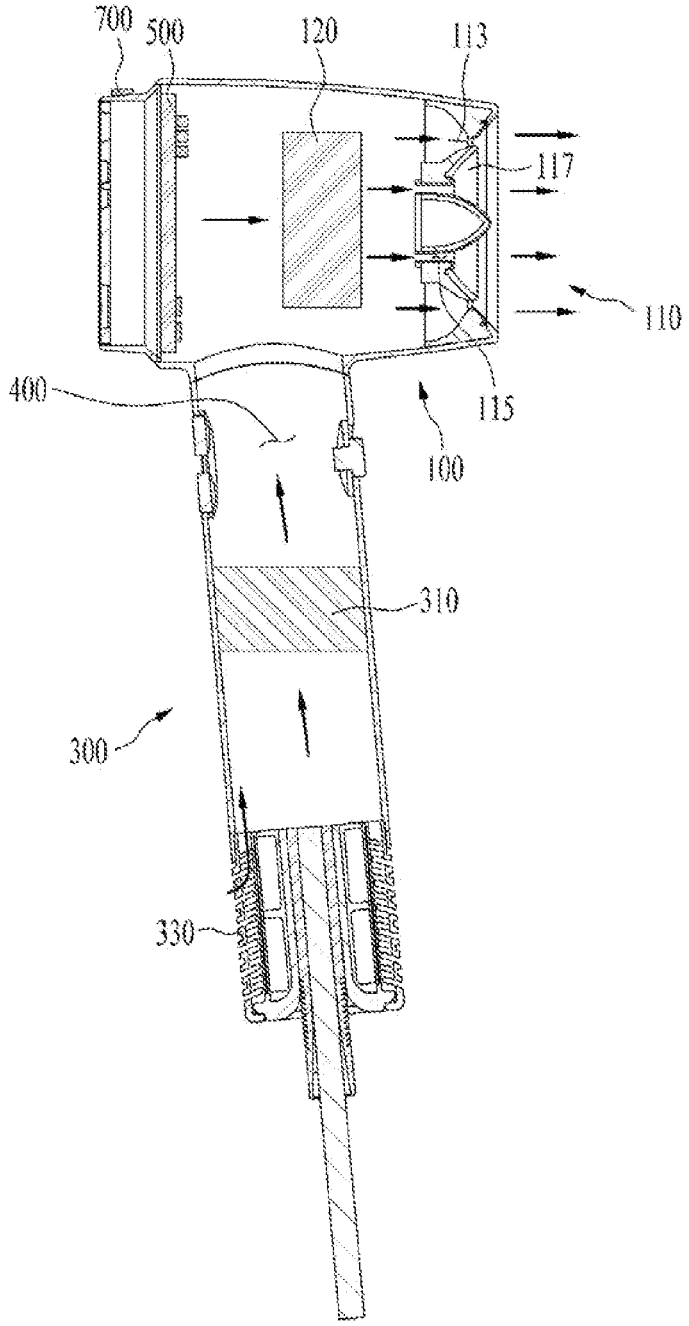

【Fig.3】
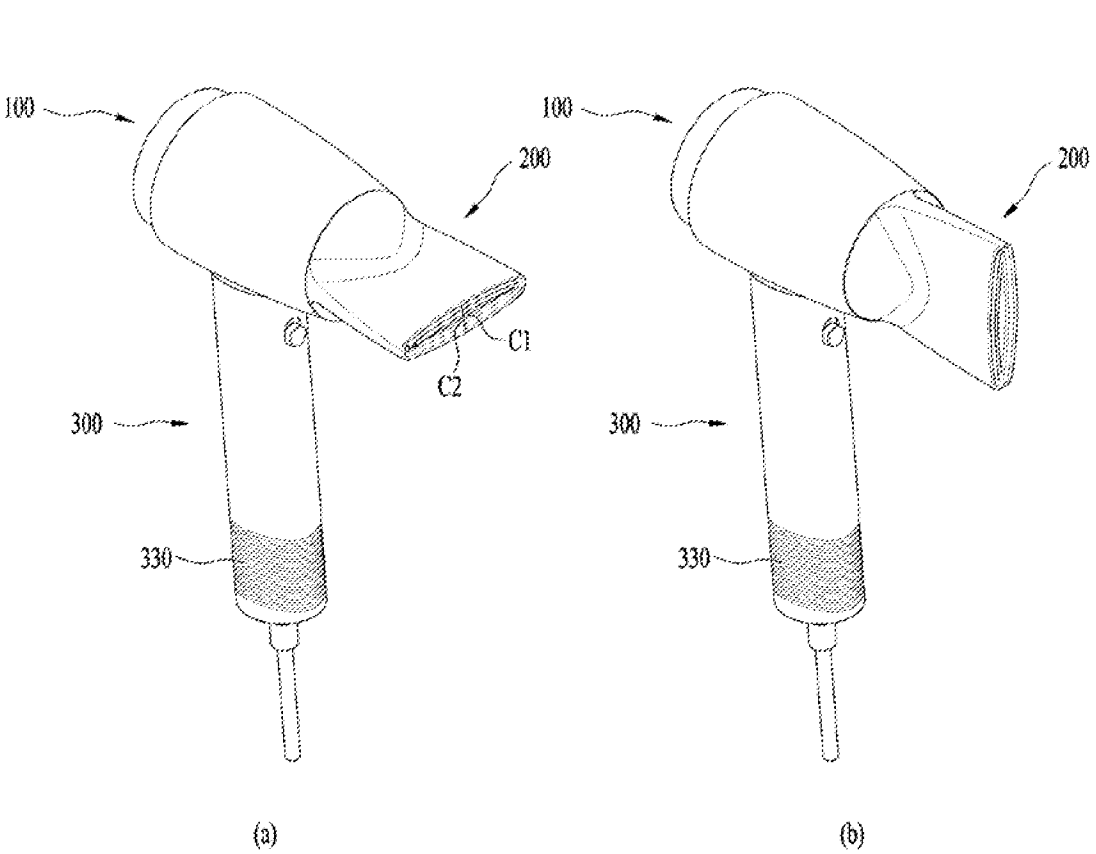

【Fig.4】
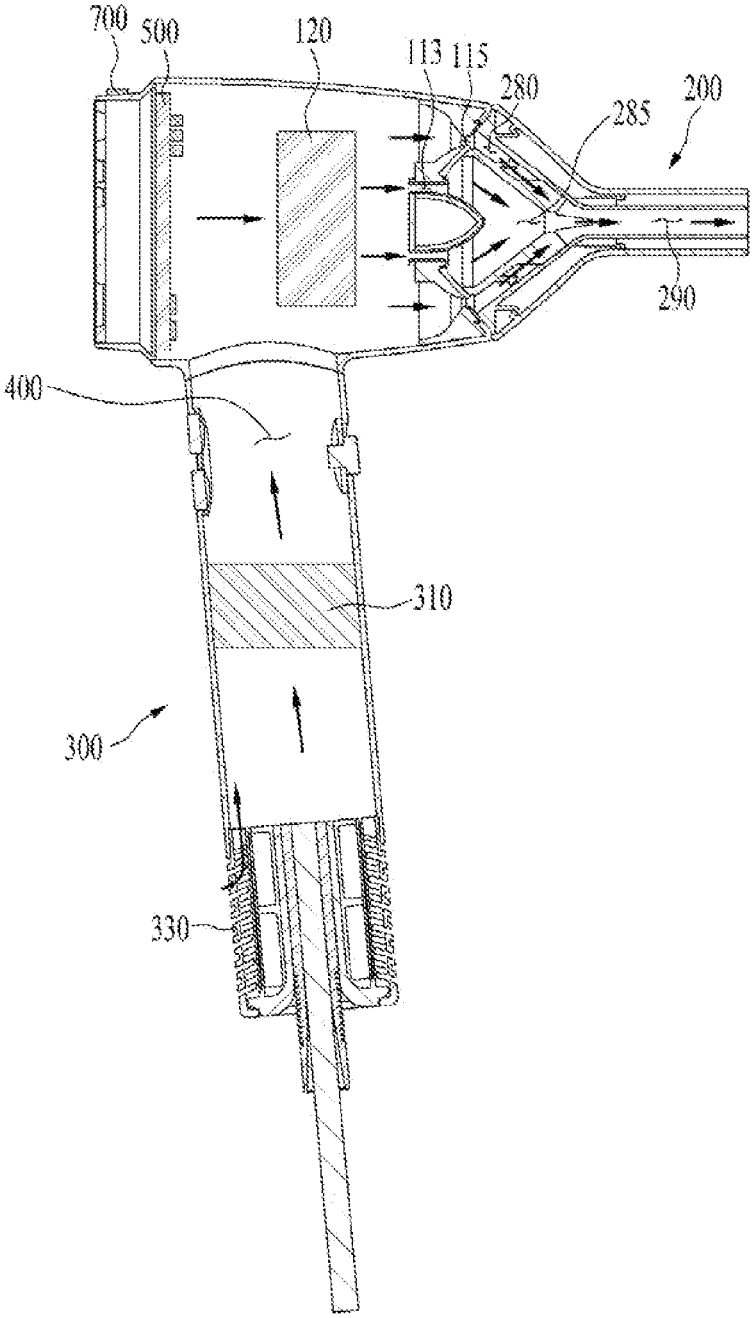

【Fig.5】
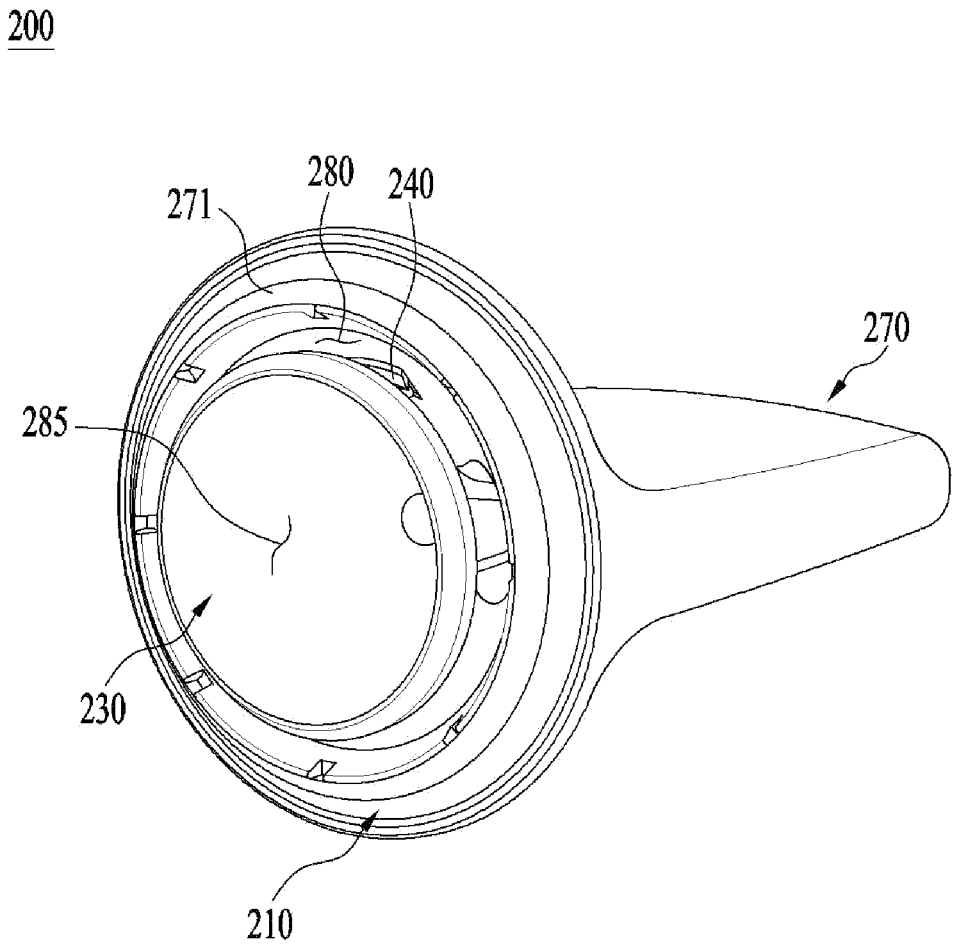

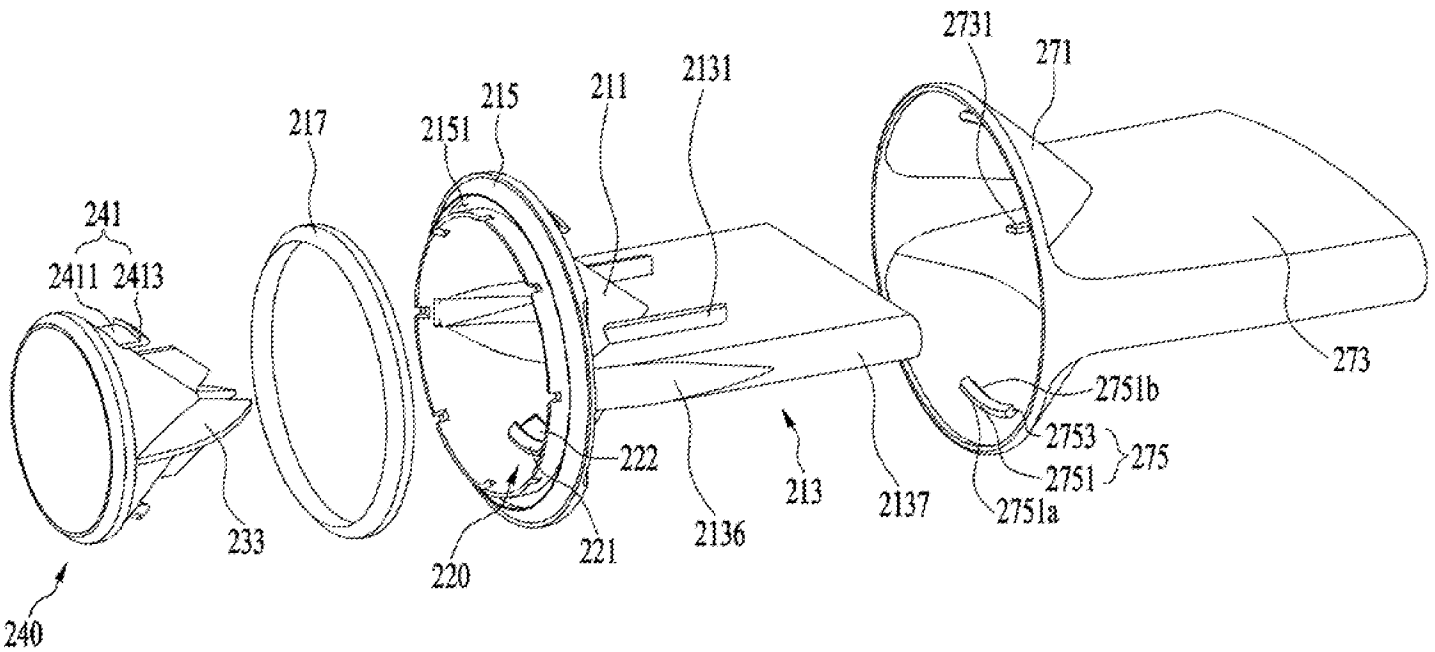
【Fig.6】

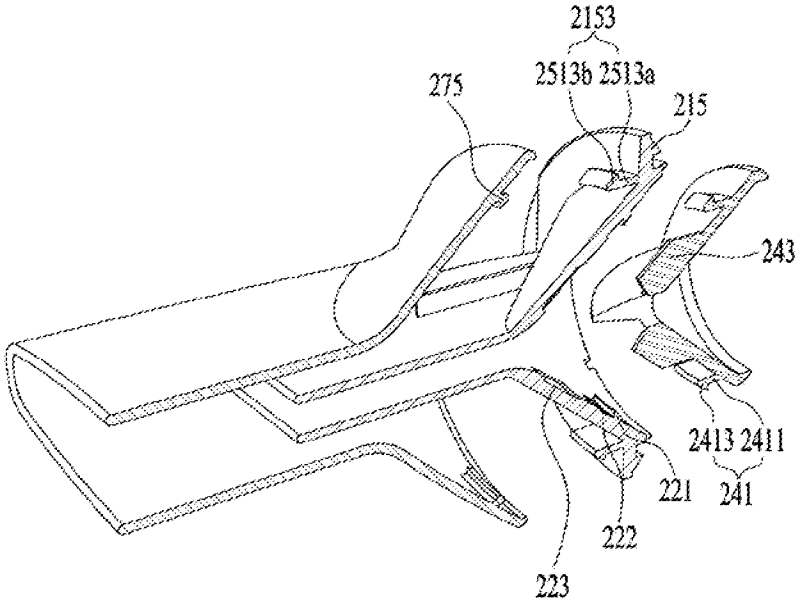
(b)
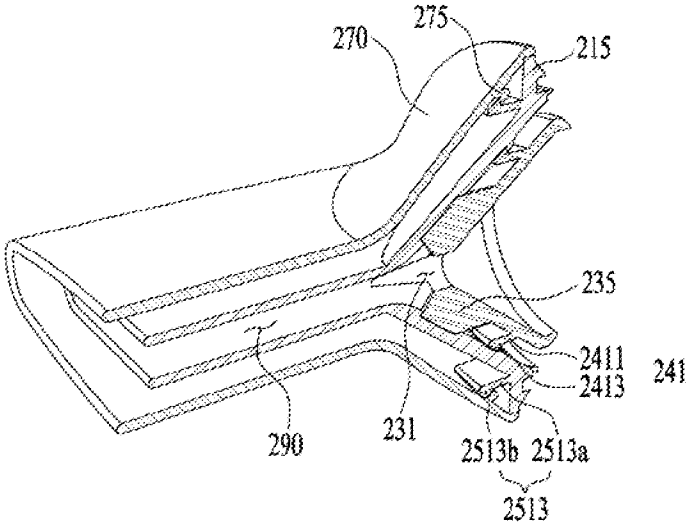
(a)
[Fig.7]

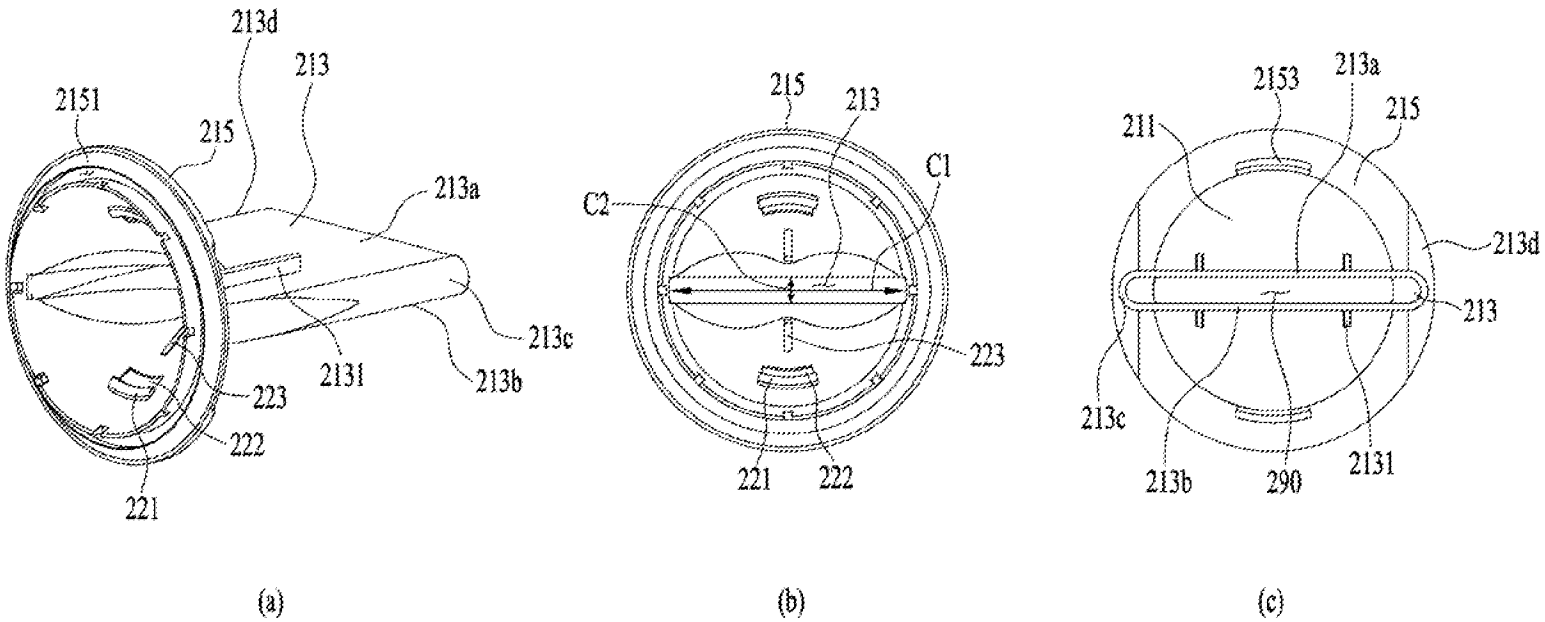
[Fig.8]

【Fig.9】
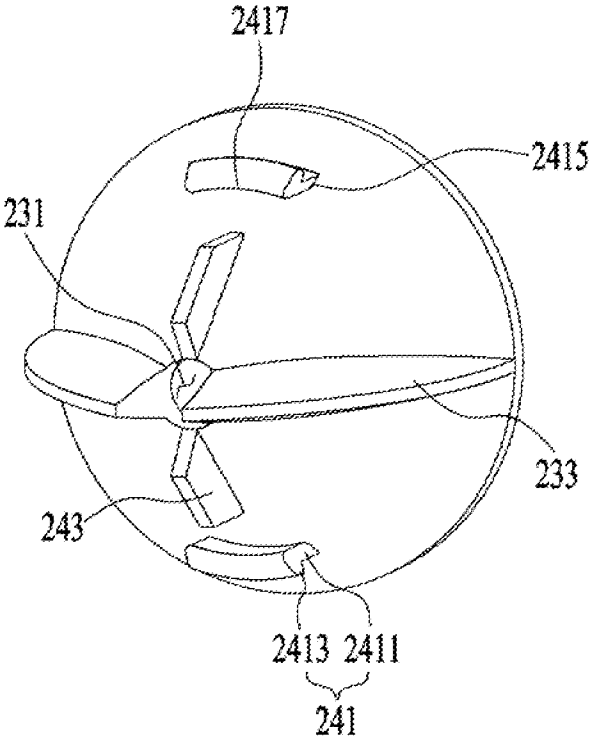
(a)
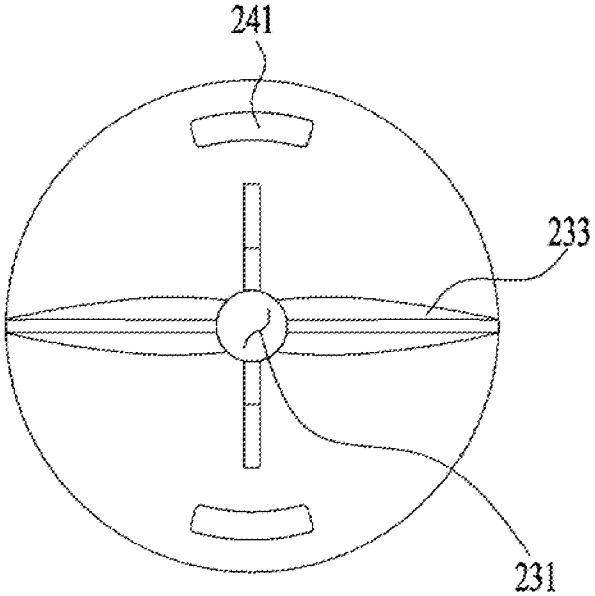
(b)

【Fig.10】
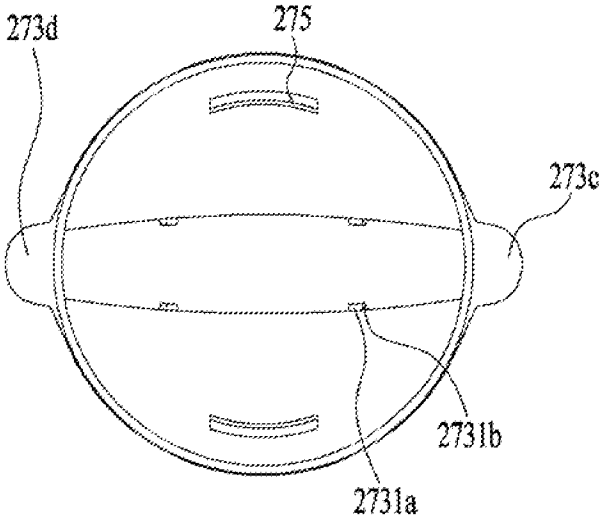
(b)
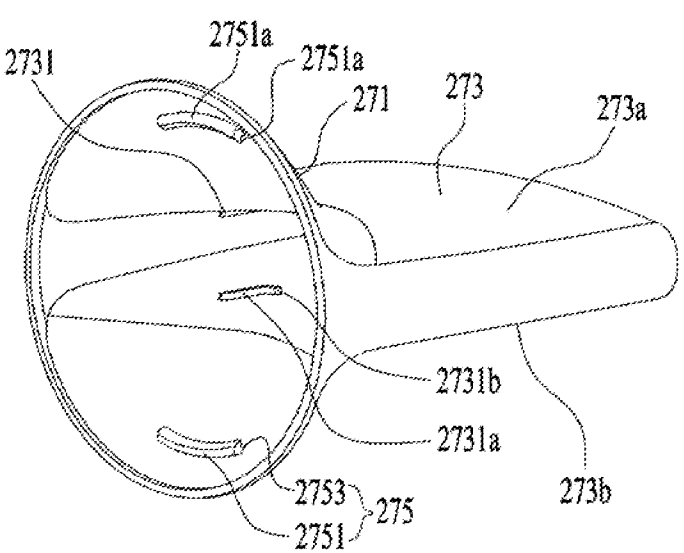
(a)

[Fig.11]
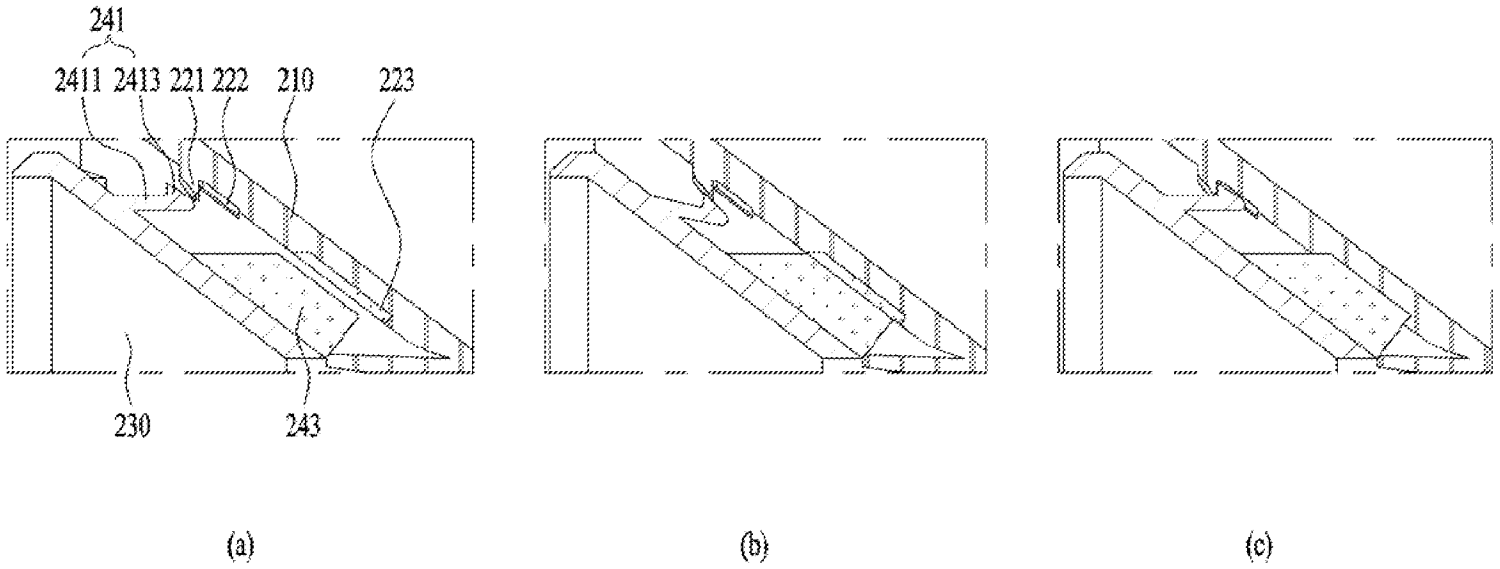

【Fig.12】
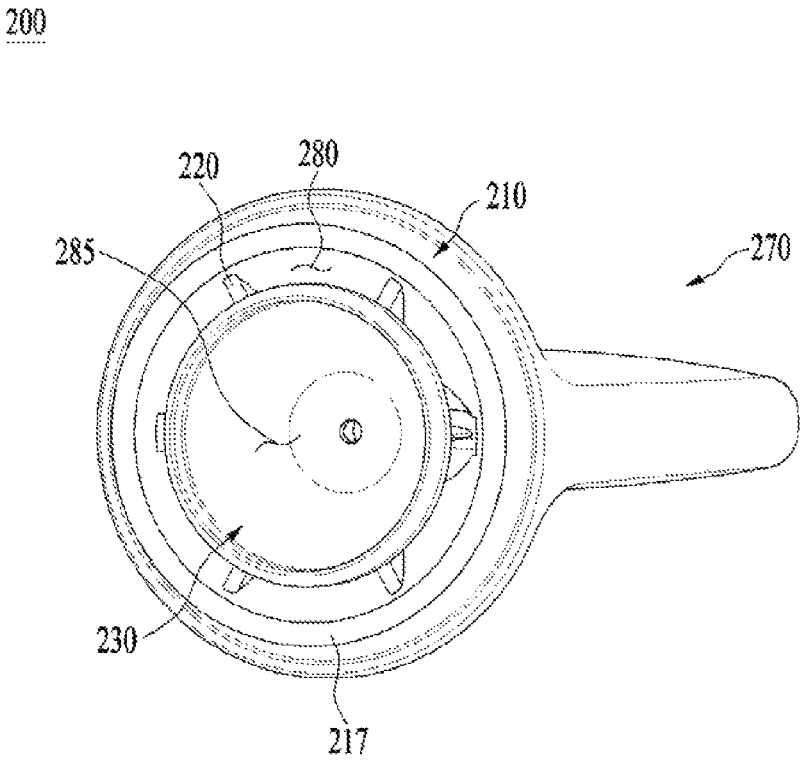

[Fig.13]
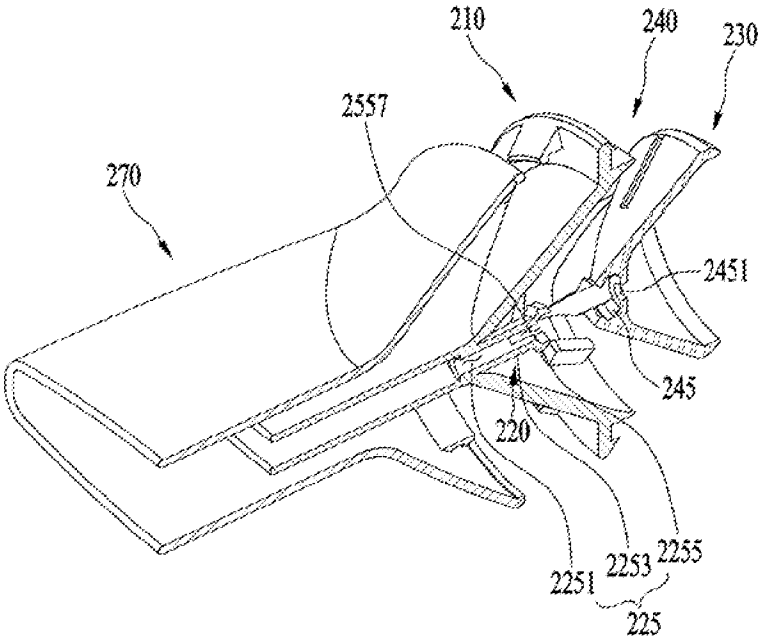
(b)
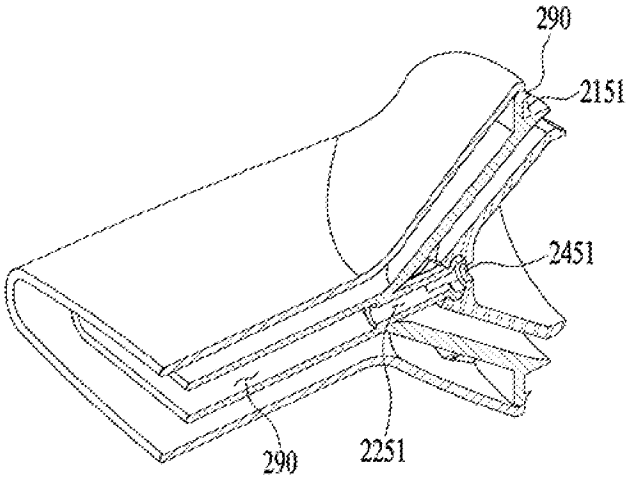
(a)

[Fig.14]
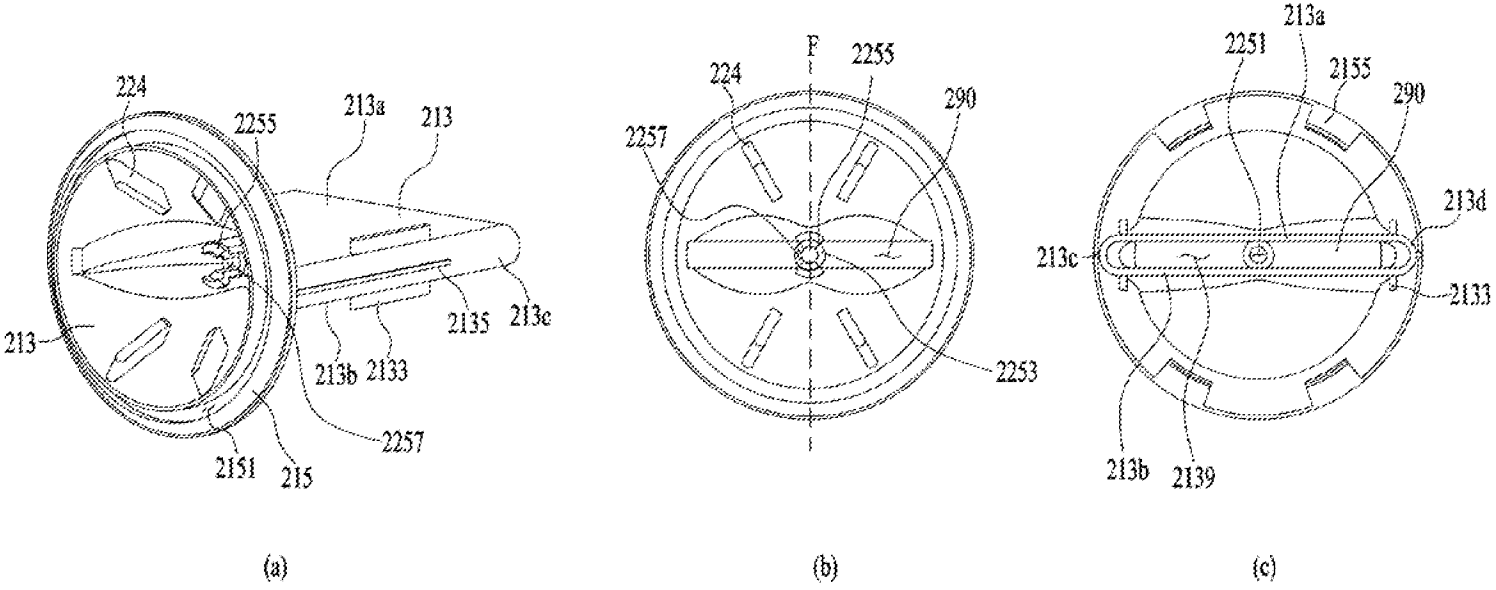

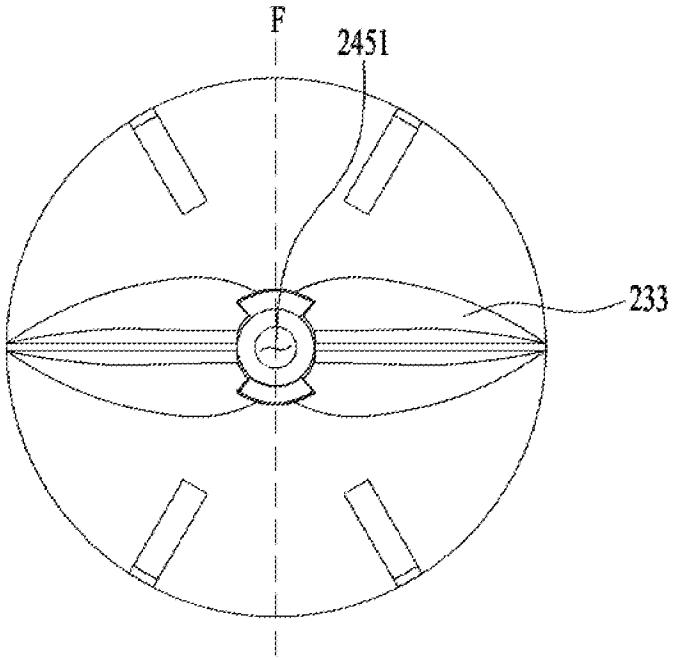
(b)
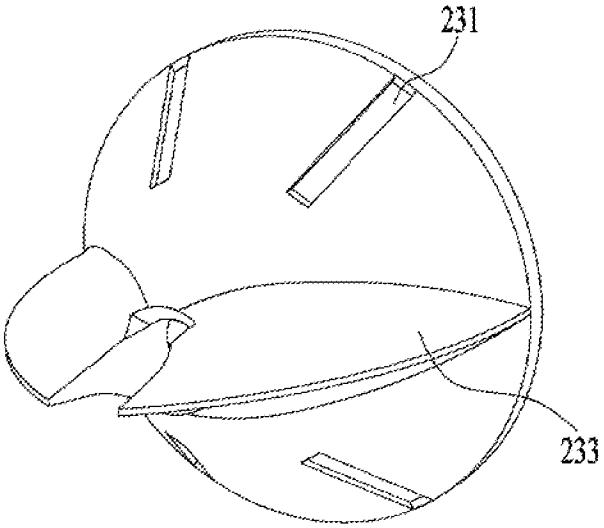
(a)
【Fig.15】

【Fig.16】
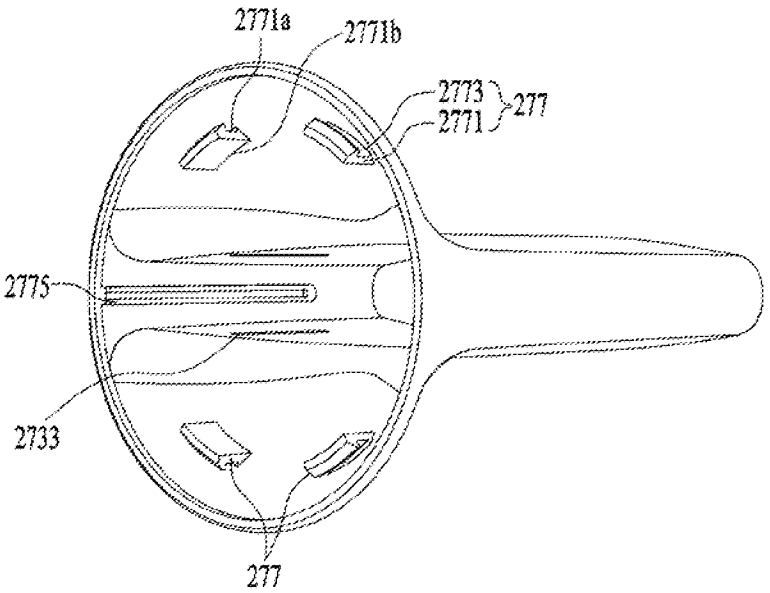
(a)
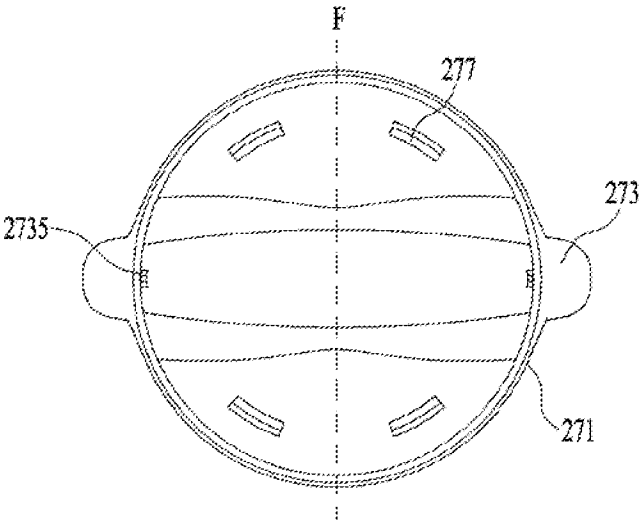
(b)

[Fig.17]
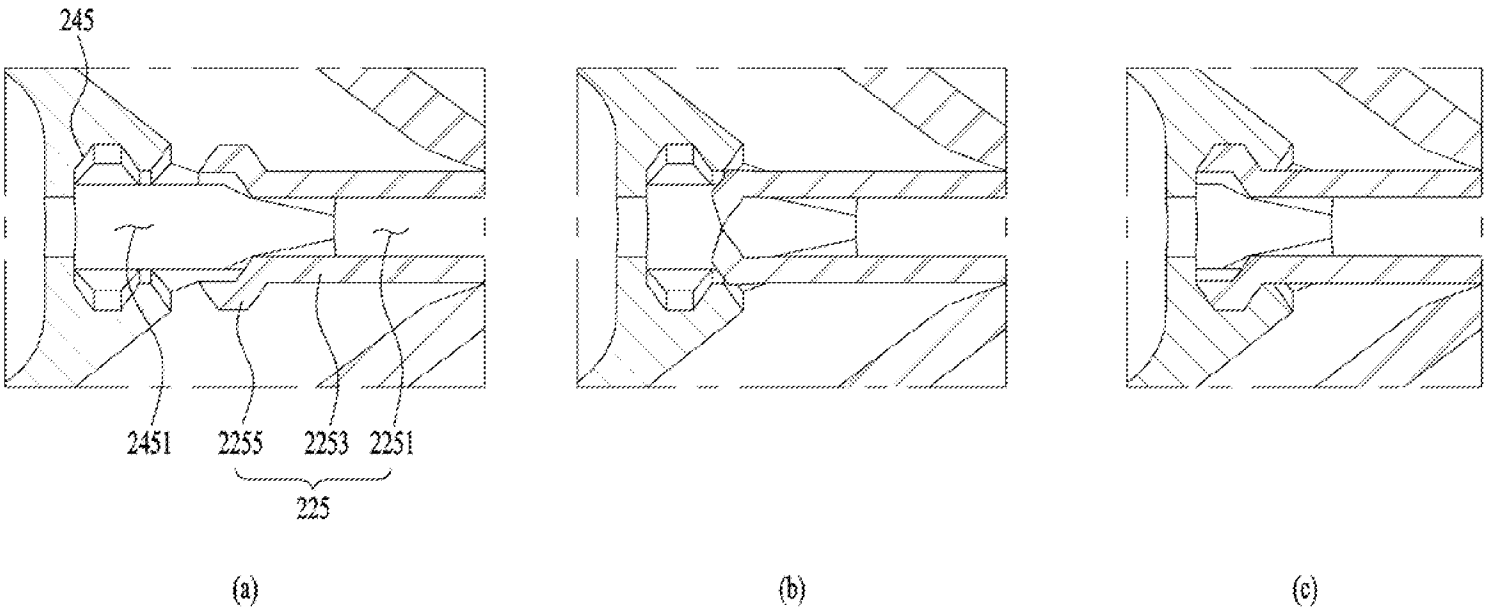

【Fig.18】
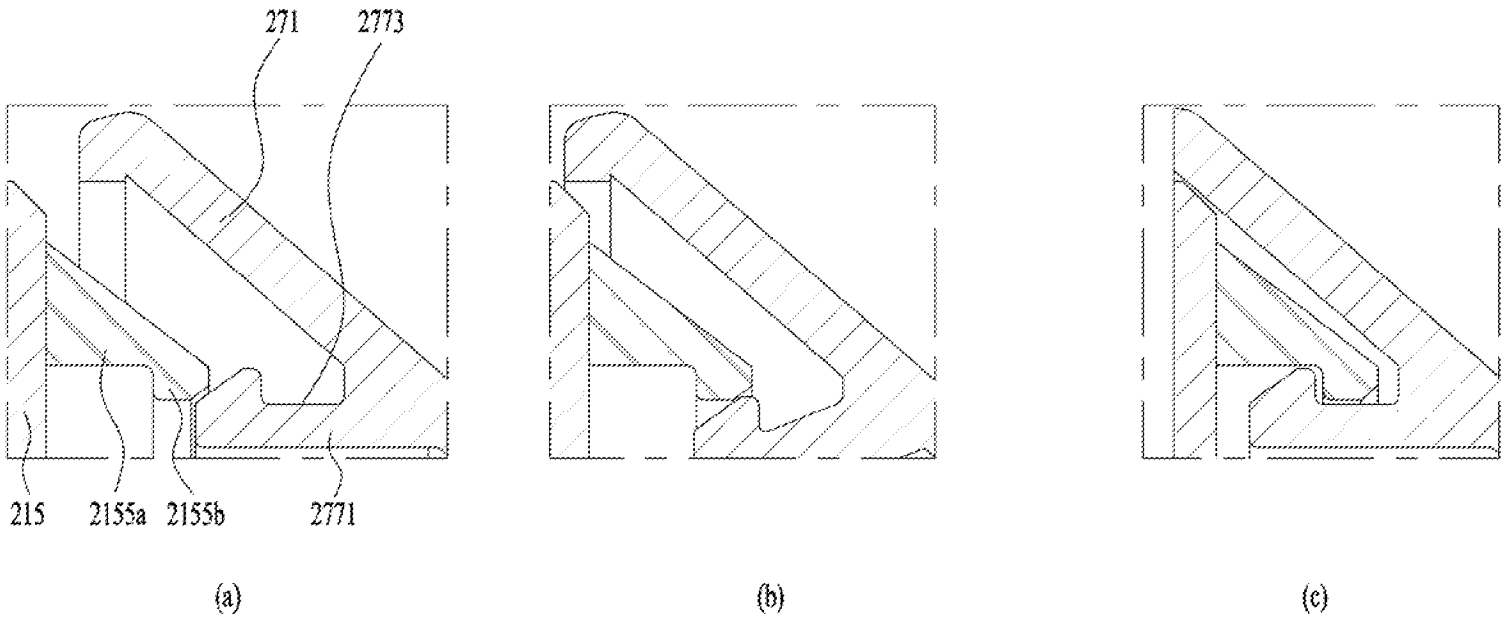

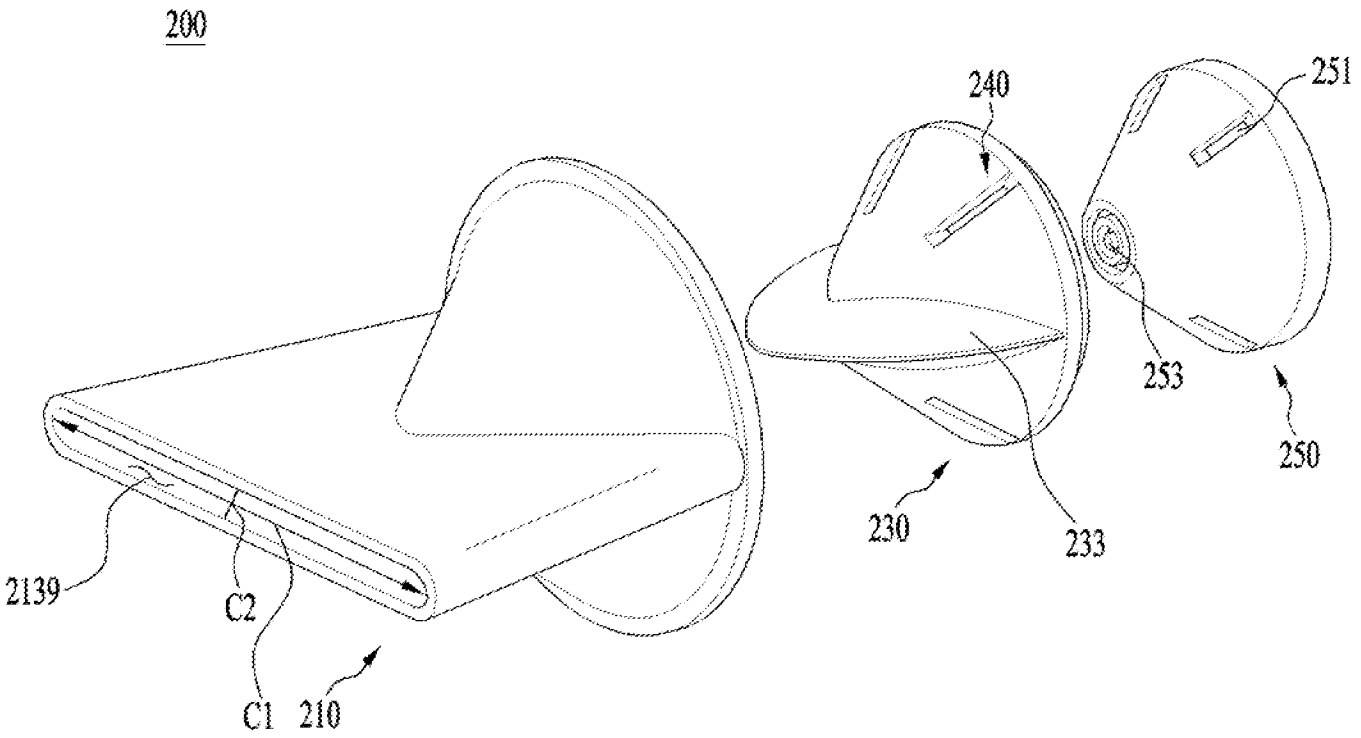
【Fig.19】

【Fig.20】
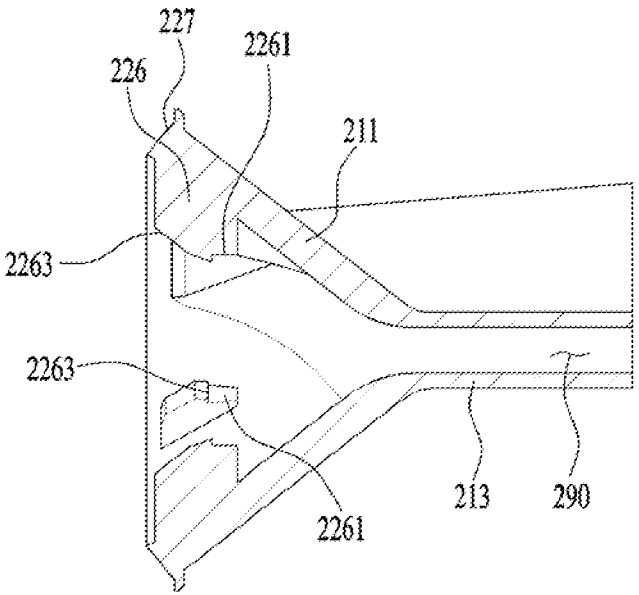
(b)
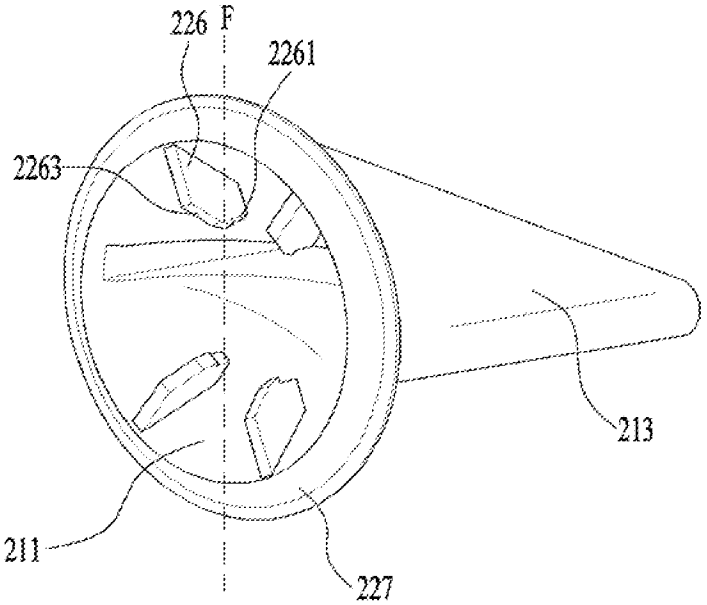
(a)

【Fig.21】
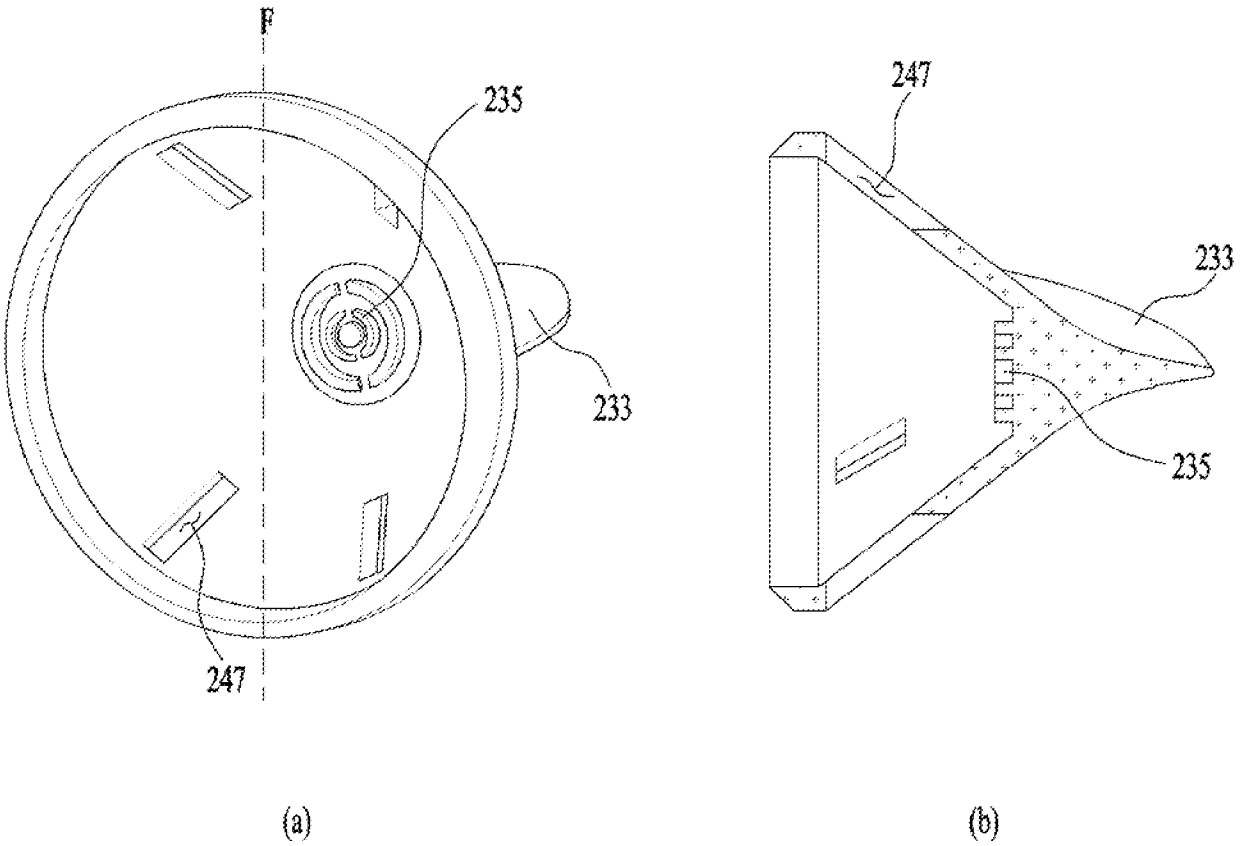

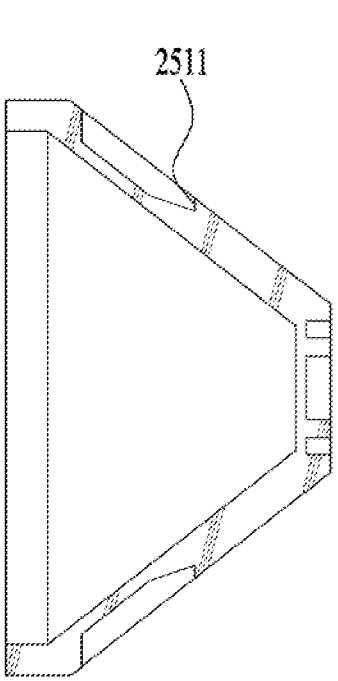
(b)
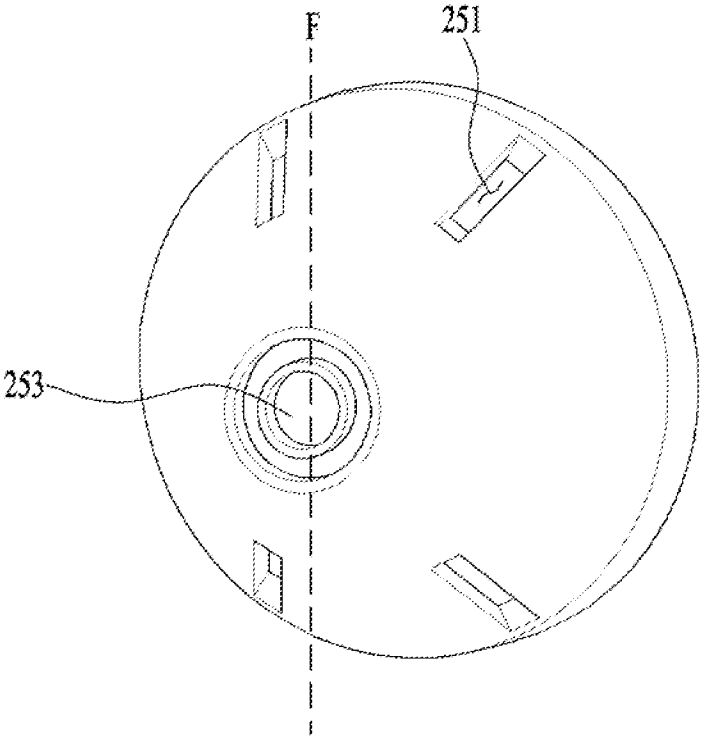
(a)
【Fig.22】

【Fig.23】
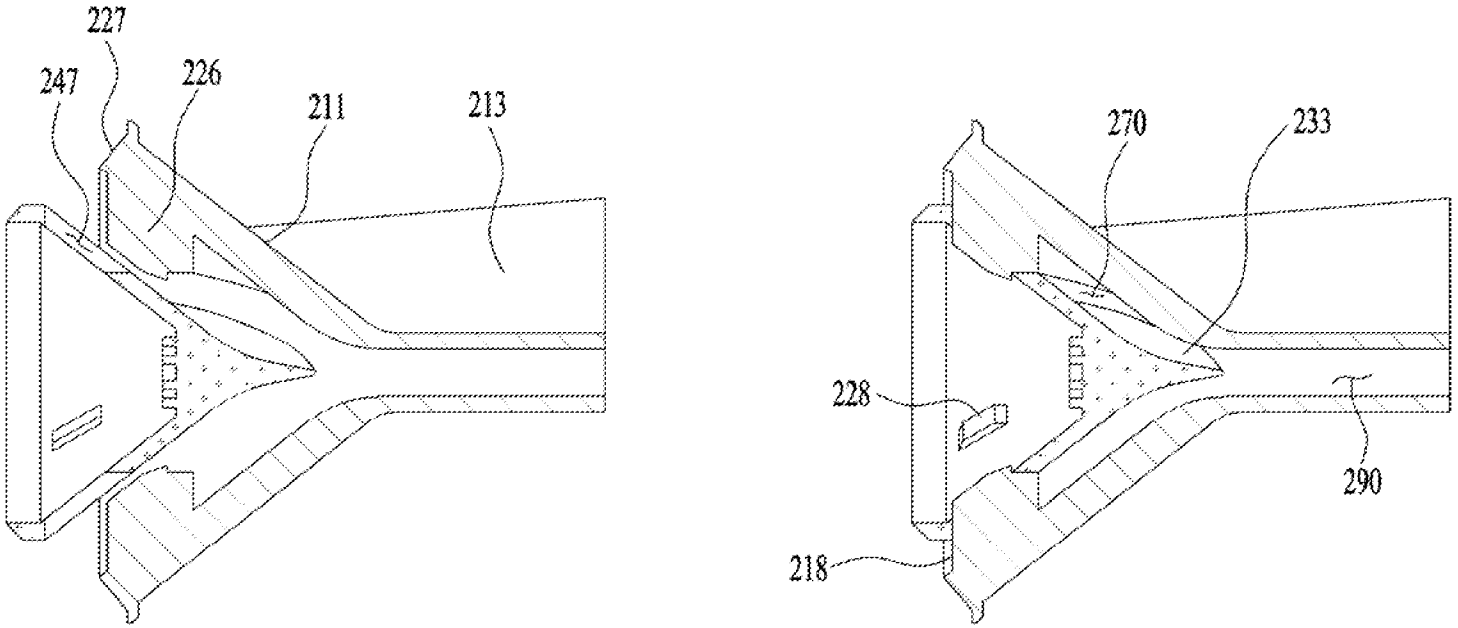

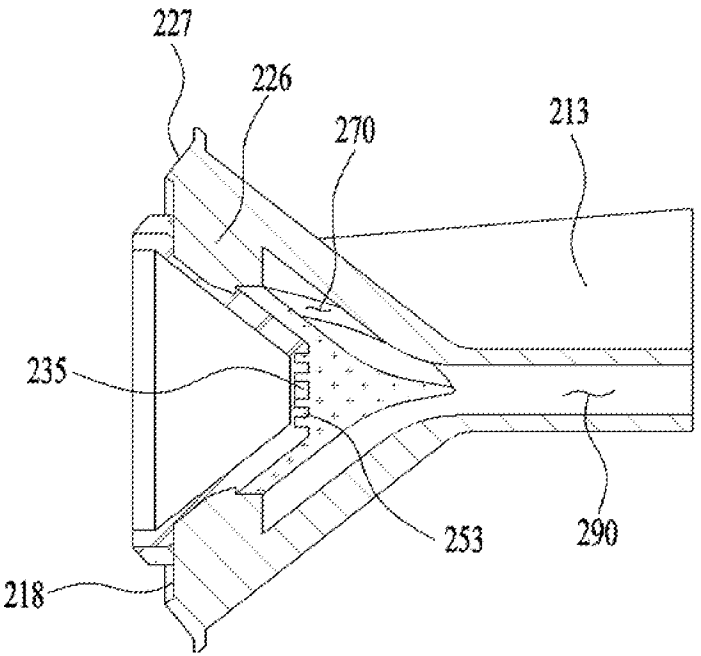
(b)
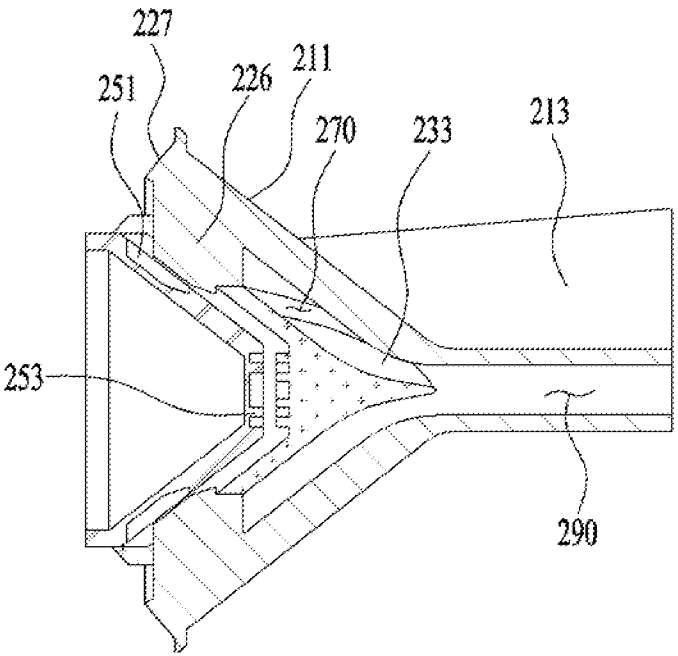
(a)
[Fig.24]

HAIR DRYER

CROSS REFERENCE TO RELATED APPLICATIONS

This application is the National Phase of PCT International Application No. PCT/KR2022/001287, filed on Jan. 25, 2022, which claims priority under 35 U.S.C. § 119 (a) to Patent Application No. 10-2021-0010024 filed in the Republic of Korea on Jan. 25, 2021, all of which are hereby expressly incorporated by reference into the present application.

TECHNICAL FIELD

The present disclosure relates to a hair dryer, and more particularly, a hair dryer from which gas introduced into a gas inlet is discharged via a gas discharger.

BACKGROUND ART

When human hair is dried as desired from a wet state or styled from a current shape to a desired shape, a hair dryer that discharges gas via a gas discharger may be used.

When a user dries hair with the hair dryer in a situation in which the hair is wet, the hair dryer may provide gas characteristics desired by the user, such as a gas temperature, a gas speed, a gas flow area, and the like.

Accordingly, a concentrator may be coupled to the hair dryer to provide gas with the characteristics desired by the user. Specifically, the concentrator may provide a three-dimensional flow of gas to the user by concentrating gas discharged from the hair dryer.

The concentrator may include a component for forming a flow channel for concentrating gas therein. Disposing and coupling the component inside and into the concentrator is an important factor to consider in supplying a stable gas flow.

Accordingly, U.S. Pat. No. 10,143,285 discloses coupling the component for forming the flow channel into the concentrator via welding or using an adhesive. However, when the internal component of the concentrator is coupled via the welding or using the adhesive, a cost may increase and a manufacturing process may become complicated. Furthermore, the concentrator heats gas introduced via a gas inlet to a certain degree using a temperature adjust unit or the like and supplies the heated gas to the user, so that an adhesive performance may be weakened when the adhesive is used.

Furthermore, bolt fastening or the like may be used to couple the internal component of the concentrator. However, the use of the bolt may increase the cost and complicate the manufacturing process. Furthermore, a bolt fastening portion for the bold fastening inevitably exists, and a flow resistance is generated by the bolt fastening portion, making it difficult to supply the stable gas flow to the user. Furthermore, because an overall weight of the concentrator is increased by the bolt, a user convenience may be reduced.

Accordingly, there is an increasing demand for a hair dryer that may efficiently couple the internal component of the concentrator. Furthermore, there is an increasing demand for a hair dryer that may provide the stable gas flow to the user with efficient arrangement of the internal component of the concentrator.

SUMMARY OF THE DISCLOSURE

Embodiments of the present disclosure are to provide a hair dryer in which internal components of a concentrator may be efficiently coupled.

Embodiments of the present disclosure are to provide a hair dryer that may provide a stable gas flow to a user by efficiently arranging internal components of a concentrator.

Embodiments of the present disclosure are to provide a hair dryer in which a plurality of flow channels are formed inside a concentrator to provide a three-dimensional gas flow to a user.

An example for solving the above-mentioned problems is to provide a hair dryer including a coupling portion for coupling and fixing internal components of a concentrator.

Furthermore, it is to provide a hair dryer including a coupling portion disposed at a location to minimize generation of a flow resistance of a gas flow provided to a user.

According to the present embodiments, a hair dryer includes a main body having a gas discharger that discharges gas to the outside, a handle extending from the main body, and a concentrator detachably coupled to the main body, wherein the concentrator receives gas discharged from the gas discharger and discharges gas to the outside.

The concentrator includes a flow channel forming member including a nozzle whose diameter decreases as a distance from the gas discharger increases, wherein gas discharged from the gas discharger is introduced into the nozzle, an auxiliary flow channel forming member disposed inside the nozzle, wherein gas flows between the nozzle and the auxiliary flow channel forming member, a nozzle coupling portion disposed on an inner circumferential surface of the nozzle and coupled to the auxiliary flow channel forming member, an auxiliary coupling portion disposed on an outer circumferential surface of the auxiliary flow channel forming member and coupled to the nozzle coupling portion, and a nozzle flow channel formed between the inner circumferential surface of the nozzle and the outer circumferential surface of the auxiliary flow channel forming member to guide gas supplied from the gas discharger to the outside.

The nozzle coupling portion and the auxiliary coupling portion are located in the nozzle flow channel, allow the flow channel forming member and the auxiliary flow channel forming member to be spaced apart from each other, and fix the flow channel forming member and the auxiliary flow channel forming member.

Furthermore, the nozzle coupling portion may include a plurality of nozzle extensions arranged along a circumferential direction of the nozzle and extending from the inner circumferential surface of the nozzle toward the outer circumferential surface of the auxiliary flow channel forming member, the auxiliary coupling portion may include a plurality of auxiliary hooks arranged along an outer circumferential surface of the auxiliary flow channel forming member, wherein each auxiliary hook extends from one end thereof facing the outer circumferential surface of the auxiliary flow channel forming member to the other end thereof facing each nozzle extension, and each auxiliary hook may have the one end positioned closer to the gas discharger than each nozzle extension and the other end protruding and hook-coupled to each nozzle extension.

Furthermore, the nozzle coupling portion may further include each nozzle recession spaced apart from each nozzle extension and defined as the inner circumferential surface of the nozzle is recessed, the auxiliary coupling portion may further include each auxiliary protrusion disposed at a location corresponding to each nozzle recession and protruding from the outer circumferential surface of the auxiliary flow channel forming member, and each nozzle recession may be located farther from the gas discharger than each nozzle extension, and each auxiliary protrusion may be inserted into and coupled to each nozzle recession.

Furthermore, the nozzle coupling portion may further include a nozzle extension recession extending from the nozzle extension and defined as the inner circumferential surface of the nozzle is recessed, and the nozzle extension recession may accommodate the other of the auxiliary hook therein.

Furthermore, the concentrator may further include a cover surrounding the flow channel forming member such that the flow channel forming member is located therein and spaced apart from the flow channel forming member, and a closing portion extending from an outer circumferential surface of the nozzle toward the cover, and the closing portion may be disposed at an end of the nozzle facing the gas discharger and coupled to the cover to shield a space between the nozzle and the cover.

Furthermore, the flow channel forming member may further include a magnetic body receiving portion defined as one surface of the closing portion facing the gas discharger is recessed, and a magnetic body received in the magnetic body receiving portion to couple the concentrator and the main body to each other.

Furthermore, the cover may include a plurality of cover protrusions arranged along an inner circumferential surface of the cover, wherein each cover protrusion protrudes toward the outer circumferential surface of the nozzle and has one surface recessed, the closing portion may include a plurality of closing hooks arranged along a circumference of the closing portion, wherein each closing hook extends toward each cover protrusion and has an end inserted into and coupled to each cover protrusion, and the cover protrusion and the closing hook may allow the inner circumferential surface of the cover and the flow channel forming member to be spaced apart from each other and fix the cover and the flow channel forming member.

Furthermore, the flow channel forming member may further include a discharger extending from the nozzle and guiding gas from the nozzle to the outside of the cover, and a discharge guider protruding from an outer circumferential surface of the discharger, the cover may further include a nozzle cover formed in a shape corresponding to the nozzle, a discharger cover extending from the nozzle cover and formed in a shape corresponding to the discharger, and a cover protruding guider protruding from an inner circumferential surface of the discharger cover and having one end curved so as to be in contact with an end of the discharge guider, and the flow channel forming member may be inserted into the cover along the cover protruding guider via the discharge guider and coupled to the cover.

Furthermore, the auxiliary flow channel forming member may further include a communication hole defined at a center of the auxiliary flow channel forming member and allowing the inside of the auxiliary flow channel forming member to be in communication with the discharger, the gas discharger may include a center hole defined at a center of the gas discharger and discharging gas therethrough, and a side hole defined in a ring shape surrounding the center hole and discharging gas therethrough, and the communication hole may guide gas flowing into the auxiliary flow channel forming member from the center hole to the discharger.

Furthermore, the nozzle coupling portion may include a plurality of nozzle protrusions arranged along a circumferential direction of the nozzle and protruding from the inner circumferential surface of the nozzle, the auxiliary coupling portion may include a plurality of auxiliary recessions defined along the outer circumferential surface of the auxiliary flow channel forming member and recessed in the outer circumferential surface of the auxiliary flow channel forming member, and each nozzle protrusion may be inserted into and coupled to each auxiliary recession.

Furthermore, the nozzle coupling portion may further include a central coupling portion extending from a center of the nozzle toward the gas discharger, the auxiliary coupling portion may further include a central recession defined by being recessed at a center of the auxiliary flow channel forming member and formed in a shape corresponding to the central coupling portion, and the central coupling portion may be inserted into and coupled to the central recession.

Furthermore, the central coupling portion may include a central coupling communication hole defined through a center thereof, the central recession may include a central recession communication hole defined through a center thereof, and the central recession communication hole and the central coupling communication hole may allow the inside of the auxiliary flow channel forming member and the discharger to be in communication with each other to guide gas flowing into the auxiliary flow channel forming member from the center hole to the discharger.

Furthermore, the central coupling portion may further include a central extension extending from a portion where the nozzle and the discharger come into contact with each other, and a central inserted portion having a larger diameter than the central extension and extending from the central extension, and the central inserted portion may be inserted into and coupled to the central recession.

Furthermore, the auxiliary flow channel forming member may further include a flow guider extending along the outer circumferential surface of the auxiliary flow channel forming member to surround the central recession, having a diameter reduced as a distance from the gas discharger increases, and coupled to the central extension, and the flow guider may be disposed in parallel with the discharger to guide gas flowing through the nozzle flow channel to the discharger.

Furthermore, the concentrator may include a plurality of cover receiving portions arranged along an inner circumferential surface of the nozzle cover, extending toward the closing portion, and having one surface recessed and coupled to the flow channel forming member, and a plurality of closing coupling portions arranged along a circumference of the closing portion, extending toward the cover receiving portion, and having an end protruding to be inserted into the cover receiving portion, and the cover receiving portion and the closing coupling portion may allow the cover and the flow channel forming member to be spaced apart from each other and fix the cover and the flow channel forming member.

Furthermore, the cover may further include a cover recessed guider defined as an inner circumferential surface of the discharger cover is recessed, the flow channel forming member may further include a discharge guide protruding from an outer circumferential surface of the discharger toward the inner circumferential surface of the discharger cover and inserted into the cover recessed guider, and the flow channel forming member may be inserted into the cover along the cover recessed guider via the discharge guide to be coupled to the cover.

Furthermore, the nozzle coupling portion may include a plurality of nozzle inserted portions arranged along the inner circumferential surface of the nozzle and protruding from the inner circumferential surface of the nozzle, the auxiliary coupling portion may include a plurality of auxiliary slits defined along the outer circumferential surface of the auxiliary flow channel forming member and defined through the outer circumferential surface of the auxiliary flow channel forming member, and each nozzle inserted portion may be inserted into and coupled to the auxiliary slit, and an end of the nozzle inserted portion may be positioned inside the auxiliary flow channel forming member.

Furthermore, the nozzle inserted portion may include a joint portion in contact with and coupled to an inner circumferential surface of the auxiliary slit, and a stepped portion protruding from the joint portion inwardly of the auxiliary flow channel forming member, and the stepped portion may be coupled to an inner circumferential surface of the auxiliary flow channel forming member so as to be in contact therewith.

Furthermore, the concentrator may further include a flow channel forming support disposed inside the auxiliary flow channel forming member and coupled to the auxiliary flow channel forming member to support the auxiliary flow channel forming member, the flow channel forming support may include a support recession defined to be recessed in an outer circumferential surface of the flow channel forming support and defined in a shape corresponding to an end of the nozzle inserted portion located inside the auxiliary flow channel forming member, and the nozzle inserted portion may pass through the auxiliary slit and may be inserted into and coupled to the support recession.

Furthermore, the auxiliary flow channel forming member may further include an auxiliary protruding coupling portion protruding from a center of the auxiliary flow channel forming member toward the gas discharger, the flow channel forming support may further include a support recessed coupling portion defined by being recessed at a center of the flow channel forming support in a shape corresponding to the auxiliary protruding coupling portion, and the auxiliary protruding coupling portion may be inserted into and coupled to the support recessed coupling portion.

Advantageous Effects

According to the embodiments of the present disclosure, the internal components of the concentrator may be easily coupled.

Furthermore, according to the embodiments of the present disclosure, the cost of manufacturing the concentrator may be reduced, so that economic feasibility may be improved.

Furthermore, according to the embodiments of the present disclosure, the manufacturing process of the concentrator may be simplified.

Furthermore, according to the embodiments of the present disclosure, the internal components of the concentrator may be efficiently arranged.

Furthermore, according to the embodiments of the present disclosure, the stable gas flow may be supplied to the user via the concentrator.

Furthermore, according to the embodiments of the present disclosure, the three-dimensional gas flow may be supplied to the user via the concentrator.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

FIG. 1 is a perspective view of a hair dryer from which a concentrator is removed according to an embodiment of the present disclosure.

FIG. 2 is a view showing an internal cross-section of a hair dryer shown in FIG. 1.

FIG. 3 is a view showing a hair dryer to which a concentrator is coupled according to an embodiment of the present disclosure.

FIG. 4 is a view showing an internal cross-section of a hair dryer to which a concentrator shown in FIG. 3 is coupled.

FIG. 5 is a perspective view of a concentrator according to an embodiment of the present disclosure.

FIG. 6 is an exploded perspective view of a concentrator according to an embodiment of the present disclosure.

FIG. 7 is a cross-sectional view of a concentrator according to an embodiment of the present disclosure.

FIG. 8 is a diagram showing a flow channel forming member of a concentrator according to an embodiment of the present disclosure.

FIG. 9 is a diagram showing an auxiliary flow channel forming member of a concentrator according to an embodiment of the present disclosure.

FIG. 10 is a view showing a cover of a concentrator according to one embodiment of the present disclosure.

FIG. 11 is a view showing a process of coupling a flow channel forming member and an auxiliary flow channel forming member to each other according to an embodiment of the present disclosure.

FIG. 12 is a perspective view of a concentrator according to another embodiment of the present disclosure.

FIG. 13 is a cross-sectional view of a concentrator according to another embodiment of the present disclosure.

FIG. 14 is a view showing a flow channel forming member of a concentrator according to another embodiment of the present disclosure.

FIG. 15 is a view showing an auxiliary flow channel forming member of a concentrator according to another embodiment of the present disclosure.

FIG. 16 is a view showing a cover of a concentrator according to another embodiment of the present disclosure.

FIG. 17 is a view showing a process of coupling a flow channel forming member and an auxiliary flow channel forming member to each other according to another embodiment of the present disclosure.

FIG. 18 is a view showing a process of coupling a flow channel forming member and a cover to each other according to another embodiment of the present disclosure.

FIG. 19 is a view showing a concentrator according to another embodiment of the present disclosure.

FIG. 20 is a view showing a flow channel forming member of a concentrator according to another embodiment of the present disclosure.

FIG. 21 is a view showing an auxiliary flow channel forming member of a concentrator according to another embodiment of the present disclosure.

FIG. 22 is a view showing a flow channel forming support of a concentrator according to another embodiment of the present disclosure.

FIG. 23 is a view showing a process of coupling a flow channel forming member and an auxiliary flow channel forming member of a concentrator to each other according to another embodiment of the present disclosure.

FIG. 24 is a view showing a process of coupling a flow channel forming support to a flow channel forming member and an auxiliary flow channel forming member of a concentrator according to another embodiment of the present disclosure.

DETAILED DESCRIPTION OF THE EMBODIMENTS

Hereinafter, embodiments of the present disclosure will be described in detail with reference to the accompanying drawings so that the present disclosure may be easily realized by those skilled in the art.

However, the present disclosure may be achieved in various different forms and is not limited to the embodiments described herein. In the drawings, parts that are not related to a description of the present disclosure are omitted to clearly explain the present disclosure and similar reference numbers will be used throughout this specification to refer to similar parts.

In the present specification, redundant descriptions of the same components are omitted.

It will be understood that, when an element is referred to as being "connected to" another element, the element can be connected to the other element or intervening elements may also be present. In contrast, when an element is referred to as being "directly connected to" another element, there are no intervening elements present.

Specific terminology used in this specification is only for convenience of description and is not intended to be limiting of the illustrative embodiments.

A singular representation may include a plural representation unless it represents a definitely different meaning from the context.

In description of the present disclosure, the terms "comprising," "including," and "having" shall be understood to designate the presence of particular features, numbers, steps, operations, elements, parts, or combinations thereof, but not to preclude the presence or addition of one or more other features, numbers, steps, operations, elements, parts, or combinations thereof.

In description of the present disclosure, the term "and/or" may include a combination of a plurality of items or any one of a plurality of listed items. For example, "A or B" may include "only A", "only B", and/or "both A and B".

FIG. 1 is a perspective view of a hair dryer from which a concentrator is removed according to an embodiment of the present disclosure. FIG. 2 is a view showing an internal cross-section of a hair dryer shown in FIG. 1. A hair dryer according to one embodiment of the present disclosure includes a main body 100, a handle 300, and a gas discharger 110 as shown in FIGS. 1 and 2.

As shown in FIG. 2, the main body 100 may have a gas flow channel 400 through which gas (e.g., air) flows therein, and may have a gas discharger 110 through which internal gas is discharged to the outside. The main body 100 may have a shape extending in a front and rear direction and may have various cross-sectional shapes such as a circular or a polygonal shape when viewed from the front.

In the present disclosure, definitions of front, rear, left, right, upper, and lower sides may be centered on the main body 100. For example, referring to FIG. 2, the gas discharger 110 may be disposed at a front side of the main body 100, and the handle 300 may have a shape extending substantially downward from the main body 100.

Gas flowing inside the main body 100 may be introduced through a gas inlet 330, and the gas inlet 330 may be defined in the main body 100 or the handle 300. When the gas inlet 330 is defined in the handle 300, the gas flow channel 400 may extend from the handle 300 to the main body 100. That is, the gas flow channel 400 may extend from the gas inlet 330 to the gas discharger 110.

Gas may be introduced from the outside via the gas inlet 330 defined in the main body 100 or the handle 300, and gas introduced to the inside may flow along the gas flow channel 400 and be discharged to the outside via the gas discharger 110 disposed at the main body 100.

The handle 300 may extend from the main body 100. FIGS. 1 and 2 show the handle 300 extending downward from the main body 100. The handle 300 may be integrally molded with the main body 100 or manufactured separately and coupled to the main body 100.

When the handle 300 is manufactured separately from the main body 100 and coupled to the main body 100, the handle 300 may be formed such that a longitudinal direction with respect to the main body 100 is fixed or variable.

For example, the handle 300 may have a hinge coupling portion, and may be coupled to the main body 100 such that the longitudinal direction of the handle 300 may be changed, that is, the handle 300 may be foldable with respect to the main body 100.

The handle 300 may be a portion gripped by a user with hand, and thus, may have a shape to improve grip convenience. There may be various extension directions of the handle 300, but for convenience of description, the direction in which the handle 300 extends from the main body 100 is the downward direction.

Referring to FIG. 2, the hair dryer according to one embodiment of the present disclosure includes a fan unit 310 that may allow gas to flow and adjust a speed of gas discharged via the gas discharger 110. The fan unit 310 may be disposed in the gas flow channel 400 to allow gas to flow, and may be disposed inside the main body 100 or inside the handle 300.

For example, when the gas inlet 330 is defined in the handle 300, the gas flow channel 400 may extend from the gas inlet 330 of the handle 300 to the gas discharger 110 of the main body 100, and the fan unit 310 may be disposed in the gas flow channel 400 located inside the handle 300.

Furthermore, a temperature adjust unit 120 that may adjust a temperature of discharged gas may be disposed inside the main body 100. FIG. 2 schematically shows the temperature adjust unit 120 disposed inside the main body 100.

Furthermore, the temperature adjust unit 120 may be of various types. The temperature adjust unit 120 may be in a scheme of heating gas by providing current to a resistor in a form of a coil to generate heat.

However, the resistor of the temperature adjust unit 120 may not necessarily be in the form of the coil, and may be of various types that may heat gas or adjust the temperature of gas using, for example, a thermoelectric element.

A schematic description of an operation scheme of the hair dryer according to one embodiment of the present disclosure along with the gas flow is as follows.

First, the user manipulates a power button disposed on the main body 100 or the handle 300. When the power button is pressed, the fan unit 310 operates and gas is introduced into the hair dryer via the gas inlet 330.

Gas introduced via the gas inlet 330 flows along the gas flow channel 400 by the fan unit 310 toward the gas discharger 110, and gas is discharged from the gas discharger 110 and provided to the user.

In such process, the flow speed of gas in the gas flow channel 400 may be adjusted by the fan unit 310 and the temperature of gas may be adjusted by the temperature adjust unit 120. Adjustment of operation states of the fan unit 310 and the temperature adjust unit 120 may be performed by the user manipulating a manipulation unit 700, or may be automatically performed based on an operation mode preset in a controller 500.

In one example, the user may want a three-dimensional gas flow when using the hair dryer. Accordingly, the hair dryer according to one embodiment of the present disclosure may include a center hole and a side hole through which gas is discharged.

Specifically, at least a portion of the gas flow channel 400 is formed inside the main body 100, and one side of the main body 100 is open. The open one side may be in communication with the gas flow channel 400. In one example, the gas discharger 110 may be disposed on the main body 100 to shield the open one side of the main body 100.

The open one side of the main body 100 may correspond to an end of the gas flow channel 400, and gas flowing through the gas flow channel 400 may be simultaneously transferred to a center hole 115 and a side hole 113 to be discharged to the outside.

There may be various shapes of the main body 100, but FIGS. 1 and 2 show a shape of the main body 100 having a circular cross-section and a length. For convenience of description below, the description will be made that the main body 100 has the shape extending in the front and rear direction and has the substantially circular cross-section, as shown in FIG. 1.

The open one side of the main body 100 may be at various locations, but may be located at a front surface of the hair dryer as shown in FIG. 2, and the gas discharger 110 may form a front surface of the main body 100 and shield the open one side as shown in FIG. 1.

In one example, in one embodiment of the present disclosure, the gas discharger 110 may include the center hole 115 and the side hole 113 as shown in FIG. 1. The center hole 115 and the side hole 113 correspond to outlets through which gas is discharged from the gas discharger 110.

The center hole 115 may be defined at the center of the gas discharger 110, and may have a circular shape. However, the shape of the center hole 115 may be a polygonal shape such as a square as needed, and a size of a diameter thereof may also vary as needed.

The side hole 113 may be defined to surround the center hole 115. For example, as shown in FIG. 1, the center hole 115 may be defined in a substantially circular shape at the center of the gas discharger 110, and the side hole 113 may be a ring-shaped opening in which the center hole 115 is defined at a center.

In the present disclosure, the ring shape may be understood as an extended shape forming a closed curve. Thus, the ring shape may define a closed cross-section surrounded by the closed curve. For example, FIG. 1 discloses the side hole 113 having a circular ring shape, and the circular ring shape may have a circular closed cross-section.

The ring shape may not necessarily be circular, and may be, for example, polygonal such as triangular or a quadrilateral. That is, in one embodiment of the present disclosure, the side hole 113 may have the circular ring shape or the polygonal ring shape, and FIG. 1 shows the side hole 113 having the substantially circular ring shape.

Furthermore, the center hole 115 and the side hole 113 may be in communication with the same gas flow channel 400 together. Referring to FIG. 2, there is one gas flow channel 400 extending from the handle 300 inside the main body 100, and the center hole 115 and side hole 113 of the gas discharger 110 are in communication with the gas flow channel 400 together to discharge gas at the same time.

Discharge gas discharged from the side hole 113 may form a sense of volume for an entirety of discharge gas discharged via the gas discharger 110. That is, a cross-sectional area of the entirety of discharge gas may correspond to a size of the closed cross-section formed by the side hole 113.

However, discharge gas of the side hole 113 may be diffused as a flow proceeds, and a cross-sectional area thereof may be reduced compared to that at the beginning as a portion of the gas flow may be dispersed toward a center of the cross-section where no gas is discharged via the side hole 113.

Accordingly, in one embodiment of the present disclosure, the center hole 115 is defined at the center of the side hole 113, and suppresses the phenomenon in which discharge gas of the side hole 113 is dispersed to the center of the cross-section with an influence of discharge gas of the center hole 115.

That is, discharge gas of the center hole 115 flows at the center of the cross-section of the entirety of discharge gas of the gas discharger 110, and suppresses discharge gas of the side hole 113 from being dispersed toward the center during the flow process, which may be advantageous for the entirety of discharge gas to maintain the initial cross-sectional area thereof.

Accordingly, discharge gas having a large cross-sectional area may be provided to the user, and the user may perform drying using gas having the sense of volume. For example, the entirety of discharge gas having the sense of volume formed via the center hole 115 and the side hole 113 may enable the user to perform the drying in a wider area.

Furthermore, in one embodiment of the present disclosure, because the center hole 115 and the side hole 113 are in communication with one gas flow channel 400, the respective gas flow channels 400 may not be formed separately, which is therefore advantageous in terms of design, and is efficient in providing three-dimensional discharge gas to the user.

In one example, referring to FIGS. 1 and 2, in one embodiment of the present disclosure, the gas discharger 110 may further include a base member 117 coupled to the open one side of the main body 100, and the base member 117 may have the center hole 115 defined at a center and the side hole 113 defined between an outer circumferential surface thereof and an outer wall of the main body 100.

FIG. 1 shows the base member 117 coupled to the open one side of the main body 100. The base member 117 may be disposed to have a shape corresponding to the open shape of the one side of the main body 100, but may not necessarily be limited thereto and may be formed in various shapes or made of various materials.

For example, the base member 117 may be partially formed in a shape different from the shape of the open one side of the main body 100 to determine the shape of the side hole 113, and may be made of the same or different material as the outer wall of the main body 100.

The base member 117 may constitute one surface of the main body 100, for example, as shown in FIG. 1, an entirety of a portion of the front surface of the main body 100, and may have the center hole 115 defined at the center and the side hole 113 defined between the outer circumferential surface thereof and the outer wall of the main body 100.

The base member 117 may be coupled to the opening of the main body 100 in various schemes, such as using a plurality of coupling ribs, or may be integrally molded with the main body 100.

In one example, as shown in FIG. 1, in one embodiment of the present disclosure, the base member 117 may have a shape that is recessed toward the inside of the main body 100 from the side hole 113 toward the center hole 115.

A center of a front surface of the base member 117 may be recessed toward the inside of the main body 100, so that the front surface may form a curved surface. Accordingly, discharge gas of the center hole 115 may be discharged from upstream of discharge gas of the side hole 113 on a flow path of discharge gas discharged via the gas discharger 110.

On the flow path of the entirety of discharge gas, when discharge gas of the center hole 115 starts to be diffused before discharge gas of the side hole 113, a cross-sectional area of discharge gas of the center hole 115 may be increased via the diffusion, and the effect that discharge gas of the center hole 115 with the increased cross-sectional area suppresses the flow or the diffusion of discharge gas of the side hole 113 toward the center may be increased.

Furthermore, the front surface of the base member 117 constituting a portion of a space in which discharge gas of the center hole 115 expands forms the curved surface, which may be advantageous in preventing formation of unnecessary turbulence. A curvature of the curved surface formed by the front surface of the base member may be variously set as needed.

In one example, one embodiment of the present disclosure may further include a guide cone 111 disposed at a center of the center hole 115 and guiding the flow of gas discharged via the center hole 115, and gas may be discharged between an inner surface of the center hole 115 and the guide cone 111.

FIG. 1 shows the guide cone 111 disposed at the center of the center hole 115. As the guide cone 111 is disposed, discharge gas of the center hole 115 is discharged into a space between the inner surface of the center hole 115 and an outer surface of the guide cone 111.

When the guide cone 111 is disposed at the center of the center hole 115, the center hole 115 may correspond to a ring-shaped outlet. That is, discharge gas of the center hole 115 may be discharged from the center hole 115 while having a ring-shaped cross-section.

As described above, discharge gas of the center hole 115 may contribute to suppressing the reduction of the cross-sectional area of discharge gas of the side hole 113 resulted from the discharge gas being recessed toward the center during the flow process. In addition, according to one embodiment of the present disclosure, the guide cone 111 may be disposed at the center of the center hole 115 to increase a level at which discharge gas of the center hole 115 is diffused outward in the cross-section.

When the cross-sectional area of discharge gas of the center hole 115 is increased as the guide cone 111 is disposed, the effect of suppressing the flow of discharge gas of the side hole 113 to the inside on the cross-section may be increased.

In one example, an end of the guide cone 111 protruding toward the gas flow channel 400 may have a conical shape. The conical shape means a shape in which a cross-section has a circular shape and a diameter of the circle gradually decreases in a length direction.

However, in the conical shape, the circle may include a shape other than a standard circle, such as an ellipse, and the decrease in the diameter may not necessarily be constant, for example, a rate of decrease in the diameter may gradually increase or decrease.

In one example, there may be various characteristics of gas desired by the user. Accordingly, the hair dryer according to one embodiment of the present disclosure may further include a concentrator to provide gas having the characteristics desired by the user.

FIG. 3 is a view showing a hair dryer to which a concentrator is coupled according to an embodiment of the present disclosure. FIG. 4 is a view showing an internal cross-section of a hair dryer to which a concentrator shown in FIG. 3 is coupled.

Referring to FIGS. 1 to 4, the hair dryer according to one embodiment of the present disclosure may include the concentrator coupled to the main body.

Specifically, a concentrator 200 may be detachably coupled to the main body 100. The main body 100 may include a coupling portion 150 formed in an annular shape along a circumference of the gas discharger 110. That is, the concentrator 200 may be coupled to the main body 100 via the coupling portion 150.

The coupling portion 150 may be disposed at an outermost side of the gas discharger 110 so as to be in contact with an inner circumferential surface of the main body 100. Accordingly, the coupling portion 150 may be supported by the inner circumferential surface of the main body 100. Furthermore, the coupling portion 150 may be disposed at the outermost side of the gas discharger 110, so that an area size thereof coupled to the concentrator 200 may be secured to the maximum.

The coupling portion 150 may be recessed rearwards toward the center hole 115. Accordingly, the concentrator 200 may be coupled to the main body 100 so as to be accommodated therein. Furthermore, the coupling portion 150 may be coupled with a magnetic body 217. That is, the coupling portion 150 may be made of a metal material and coupled to the magnetic body 217. Accordingly, in the concentrator 200, the magnetic material 217 may be disposed at a location corresponding to the coupling portion 150.

As a result, the user may easily attach and detach the concentrator 200 to and from the main body 100. That is, a convenience of use of the user may be increased.

Furthermore, one surface of the concentrator 200 facing the coupling portion 150 may be formed in an annular shape. Furthermore, the magnetic body 217 may be formed in an annular shape. That is, all of the one surface of the concentrator 200 facing the coupling portion 150, the magnetic body 217 and the coupling portion 150 may be formed in the annular shape.

Accordingly, as the coupling portion 150 is formed in the annular shape, the concentrator 200 may be coupled to the main body 100 via the coupling portion 150 independently of a coupling direction of the concentrator 200. The meaning of the concentrator 200 being coupled to the main body 100 via the coupling portion 150 independently of the coupling direction of the concentrator 200 described above is as follows. A rotation axis passing through a center of the main body 100 and a rotation axis passing through a center of the concentrator 200 may be the same. Furthermore, the concentrator 200 may be coupled to the main body 100 regardless of a rotation angle based on the rotation axis. That is, the concentrator 200 may rotate 360 degrees while being coupled to the main body 100. To sum up, the coupling of the concentrator 200 and the main body 100 may be made non-directionally.

As a result, the user may easily attach and detach the concentrator 200 to and from the main body 100. That is, the convenience of use of the user may be increased.

Furthermore, the concentrator 200 may have a flow channel for guiding introduced gas discharged from the gas discharger 110 to the outside. That is, the concentrator 200 may include a flow channel forming member 210 and an auxiliary flow channel forming member 230 that form the flow channel therein.

The flow channel forming member 210 may include a nozzle 211 facing the gas discharger 110 and into which gas discharged from the gas discharger 110 flows. A diameter of the nozzle 211 may decrease as a distance from the gas discharger 110 increases.

Furthermore, the auxiliary flow channel forming member 230 may be disposed inside the nozzle 211. Furthermore, the auxiliary flow channel forming member 230 may be formed in a shape corresponding to the nozzle 211. Accordingly, a nozzle flow channel 280 may be formed between an inner circumferential surface of the nozzle 211 and an outer circumferential surface of the auxiliary flow channel forming member 230.

A diameter of the nozzle flow channel 280 may decrease as the distance from the gas discharger 110 increases. That is, the nozzle flow channel 280 may concentrate gas discharged from the gas discharger 110 and introduced into the concentrator 200 toward a center of the concentrator 200.

Furthermore, the flow channel forming member 210 may include a discharger 213 extending from the nozzle 211. The discharger 213 may guide gas transferred from the nozzle 211 to the outside. Furthermore, the discharger 213 may include a discharge hole 2139 through which gas flowing inside the discharger 213 is discharged to the outside.

The discharger 213 may extend from the nozzle 211 such that a length thereof in one direction C1 is greater than a length thereof in the other direction C2. Furthermore, in the discharger 213, as the distance from the discharge hole 2139 decreases, a length in one direction C1 of the elliptical shape formed by the cross-section may be constant or increase, and a length in the other direction C2 may be constant or decrease.

As the distance from the discharge hole 2139 decreases along a length direction, the length in the one direction C1 of the elliptical shape of the cross-section increases, so that the discharger 213 may secure a length of discharged gas. Furthermore, as the distance from the discharge hole 2139 decreases along the length direction, the length in the other direction C2 of the elliptical shape of the cross-section of the discharger 213 may be constant.

Specifically, the discharger 213 may include a discharger expansion 2136 extending to increase the length in the one direction C1. Furthermore, the discharger 213 may include a discharger extension 2137 extending to have the constant length in the one direction C1.

Accordingly, a speed of the gas flow, a concentration of the gas flow, and the like may be easily changed by changing only the length in the one direction C1. However, amounts of change in the length in the one direction C1 and the length in the other direction C2 of the elliptical shape of the cross-section of the discharger 213 may be variously determined as needed.

As a result, the user may receive a concentrated gas flow that has passed through the concentrator 200. Furthermore, the user may effectively dry or style the hair with the concentrated gas flow.

Furthermore, the discharger 213 may extend further inwardly of the nozzle 211 toward the gas discharger 110. That is, the discharger 213 may be disposed at the center of the concentrator 200, and the nozzle 211 may extend to cover the discharger 213 from both ends oriented in the other direction C2. Accordingly, the discharger 213 may sufficiently secure a flow distance of the gas flow concentrated by the nozzle 211. As a result, a smooth and stable gas flow may be provided to the user.

However, as described above, the flow channel forming member 210, the auxiliary flow channel forming member 230, and the like for forming the flow channel inside the concentrator 200 must be disposed inside and fixed to the concentrator 200. Accordingly, a method for fixing the flow channel forming member 210, the auxiliary flow channel forming member 230, and the like while maximally maintaining the concentration of gas passing through the concentrator 200 is required.

The hair dryer according to one embodiment of the present disclosure may include a nozzle coupling portion 220 and an auxiliary coupling portion 240 for separating the flow channel forming member 210 and the auxiliary flow channel forming member 230 from each other and fixing the members 210 and 230 (i.e., the flow channel forming member 210 and the auxiliary flow channel forming member 230).

FIG. 5 is a perspective view of a concentrator according to an embodiment of the present disclosure. FIG. 6 is an exploded perspective view of a concentrator according to an embodiment of the present disclosure. FIG. 7 is a cross-sectional view of a concentrator according to an embodiment of the present disclosure. FIG. 8 is a diagram showing a flow channel forming member of a concentrator according to an embodiment of the present disclosure. FIG. 9 is a diagram showing an auxiliary flow channel forming member of a concentrator according to an embodiment of the present disclosure.

Specifically, (a) in FIG. 7 is a cross-sectional view of a state in which the flow channel forming member, the auxiliary flow channel forming member, and a cover are coupled to each other, and (b) in FIG. 7 is a cross-sectional view of a state in which the flow channel forming member, the auxiliary flow channel forming member, and the cover are separated from each other.

(a) in FIG. 8 is a perspective view of the flow channel forming member, (b) in FIG. 8 is a view showing the flow channel forming member viewed from one surface of the flow channel forming member facing the gas discharger, and (c) in FIG. 8 is a diagram showing a flow channel forming member viewed from a side opposite to that in (b) in FIG. 8.

(a) in FIG. 9 is a perspective view of the auxiliary flow channel forming member, and (b) in FIG. 9 is a view showing the auxiliary flow channel forming member viewed from one surface of the auxiliary flow channel forming member far from the gas discharger.

Referring to FIGS. 5 to 9, the hair dryer according to one embodiment of the present disclosure may include the nozzle coupling portion 220 and the auxiliary coupling portion 240.

Specifically, the concentrator 200 may include the nozzle coupling portion 220 disposed on the inner circumferential surface of the nozzle 211. The nozzle coupling portion 220 may be coupled to the auxiliary flow channel forming member 230. Furthermore, the concentrator 200 may include the auxiliary coupling portion 240 disposed on the outer circumferential surface of the auxiliary flow channel forming member 230. The auxiliary coupling portion 240 may be coupled to the nozzle coupling portion 220.

That is, the nozzle coupling portion 220 and the auxiliary coupling portion 240 may allow the flow channel forming member 210 and the auxiliary flow channel forming member 230 to be spaced apart from each other to form the nozzle flow channel 280 between the inner circumferential surface of the flow channel forming member 210 and the outer circumferential surface of the auxiliary flow channel forming member 230. Furthermore, the nozzle coupling portion 220 and the auxiliary coupling portion 240 may fix the flow channel forming member 210 and the auxiliary flow channel forming member 230.

Furthermore, the nozzle coupling portion 220 may be disposed in the nozzle flow channel 280. Correspondingly, the auxiliary coupling portion 240 may be disposed in the nozzle flow channel 280. Accordingly, the nozzle coupling portion 220 and the auxiliary coupling portion 240 may be spaced apart from the discharger 213 through which gas is discharged to the outside. That is, the nozzle coupling portion 220 and the auxiliary coupling portion 240 may be prevented from being disposed in a discharger flow channel 290 formed inside the discharger 213.

Accordingly, even when a flow resistance of the gas flow is generated by the nozzle coupling portion 220 and the auxiliary coupling portion 240, the flow resistance of the gas flow may be sufficiently compensated for in the discharger flow channel 290 before providing the gas flow to the user. As a result, even when the nozzle coupling portion 220 and the auxiliary coupling portion 240 are disposed, and the stable and smooth gas flow may be provided to the user.

In one example, shapes of the nozzle coupling portion 220 and the auxiliary coupling portion 240 need to be determined to easily couple the flow channel forming member 210 and the auxiliary flow channel forming member 230 and provide strong coupling forces.

Referring to FIGS. 7 to 10, the nozzle coupling portion 220 according to one embodiment of the present disclosure may include a nozzle extension 221 extending from the inner circumferential surface of the nozzle 211 toward the outer circumferential surface of the auxiliary flow channel forming member 230. Furthermore, the auxiliary coupling portion 240 may include an auxiliary hook 241 extending from one end 2415 facing an outer circumferential surface of the auxiliary flow channel forming member 230 to the other end 2417 facing the nozzle extension 221. That is, the auxiliary hook 241 may extend from the outer circumferential surface of the auxiliary flow channel forming member 230 in a direction away from the gas discharger 110.

In the auxiliary hook 241, one end 2415 may be located closer to the gas discharger 110 than the nozzle extension 221. Furthermore, the other end 2417 of the auxiliary hook 241 may protrude toward the inner circumferential surface of the nozzle 211. That is, the auxiliary hook 241 may include an auxiliary hook extension 2411 extending from the outer circumferential surface of the auxiliary flow channel forming member 230. Furthermore, a auxiliary hook protrusion 2413 protruding from the auxiliary hook extension 2411 may be included.

Accordingly, in the auxiliary hook 241, the auxiliary hook protrusion 2413 may be hook-coupled to the nozzle extension 221. Being hook-coupled may mean that the nozzle extension 221 is in contact with and is engaged with an inner surface of the auxiliary hook protruding part 2413 and an outer surface of the auxiliary hook extension part 2411.

As a result, the auxiliary flow channel forming member 230 may be inserted into the flow channel forming member 210 and may be easily fixed by being spaced apart from the flow channel forming member 210 by the nozzle extension 221 and the auxiliary hook 241. That is, because the auxiliary flow channel forming member 230 may be coupled to the flow channel forming member 210 without a need for separate bolt fastening, an adhesive, or welding, a manufacturing process may be simplified. Furthermore, because a separate member or process for fixing is omitted, an economic efficiency may be increased.

Furthermore, a length of the auxiliary hook protrusion 2413 protruding toward the inner circumferential surface of the nozzle 211 may decrease as the distance from the gas discharger 110 increases. That is, the auxiliary hook protrusion 2413 may be inclined in a shape corresponding to the nozzle 211. Accordingly, when the auxiliary hook protrusion 2413 is coupled to the nozzle extension 221, an unnecessary impact between the auxiliary hook protrusion 2413 and the inner circumferential surface of the nozzle 211 may be prevented.

Furthermore, the nozzle coupling portion 220 may further include a nozzle extension recession 222 extending from the nozzle extension 221 and defined as the inner circumferential surface of the nozzle 211 is recessed. When the auxiliary hook protrusion 2413 is coupled to the nozzle extension 221 by the nozzle extension depression 222, the impact with the nozzle 211 may be maximally prevented. Furthermore, the auxiliary hook protrusion 2413 may further protrude inwardly of the nozzle extension depression 222. Accordingly, an area size of the auxiliary hook protrusion 2413 in contact with the nozzle extension depression 222 is increased in addition to an area size thereof in contact with the nozzle extension 221, so that a great coupling force may be provided.

The nozzle extension 221 may include a plurality of nozzle extensions along the inner circumferential surface of the nozzle 211. Furthermore, the auxiliary hook 241 may include a plurality of auxiliary hooks along the outer circumferential surface of the auxiliary flow channel forming member 230 corresponding to the nozzle extension 221. Specifically, the nozzle extension 221 and the auxiliary hook 241 may be disposed symmetrically with respect to the aforementioned one direction C1. This is to avoid an interference with a flow guider 233 to be described later. Accordingly, the nozzle extension 221 and the auxiliary hook 241 may respectively include the plurality of nozzle extensions and the plurality of auxiliary hooks to increase the coupling force, and an internal space of the nozzle flow channel 280 may be efficiently utilized with efficient arrangement with the flow guider 233.

The aforementioned flow guider 233 may be formed along the outer circumferential surface of the auxiliary flow channel forming member 230. That is, the flow guider 233 may extend from one end of the auxiliary flow channel forming member 230 facing the gas discharger 110 to the other end facing the outside. Furthermore, the flow guider 233 may be disposed in parallel with the discharger 213. Furthermore, a diameter of the flow guider 233 may decrease as a distance from the gas discharger 110 increases. That is, the flow guider 233 may be formed in a thin wing shape.

Accordingly, the flow guider 233 may guide gas flowing through the nozzle flow channel 280 to the discharger 213. Thus, gas flowing through the nozzle flow channel 280 may be stably guided toward the discharger 213 with the flow guider 233. Furthermore, the flow guider 233 may be disposed in parallel with the discharger 213 to give directionality of coupling when the auxiliary flow channel forming member 230 is inserted into the flow channel forming member 210.

Separation of the flow channel forming member 210 and the auxiliary flow channel forming member 230 caused by a force applied in a direction closer to the gas discharger 110 may be prevented as much as possible with hook coupling of the nozzle extension 221 and the auxiliary hook 241. However, there is a possibility that the flow channel forming member 210 and the auxiliary flow channel forming member 230 are spaced apart from each other by a predetermined distance and separated from each other by a force applied in a direction away from the gas discharger 110. Furthermore, when the nozzle extension 221 and the auxiliary hook 241 are hook-coupled to each other, there may be a possibility of damage to the nozzle extension 221 and the auxiliary hook 241 when a coupling direction is wrong.

To solve such problem, the nozzle coupling portion 220 according to one embodiment of the present disclosure may further include a nozzle recession 223 spaced apart from the nozzle extension 221 and recessed into the inner circumferential surface of the nozzle 211. Furthermore, the auxiliary coupling portion 240 may further include an auxiliary protrusion 243 disposed at a location corresponding to the nozzle recession 223. The auxiliary protrusion 243 may protrude from the outer circumferential surface of the auxiliary flow channel forming member 230 toward the nozzle depression 223. The auxiliary protrusion 243 may be inserted into and coupled to the nozzle recession 223.

Accordingly, even when the force is applied in the direction away from the gas discharger 110, the auxiliary protrusion 243 may be supported in contact with the nozzle recession 223. That is, the auxiliary flow channel forming member 230 may be spaced apart from and fixed inside the flow channel forming member 210.

As a result, the auxiliary flow channel forming member 230 may receive a great force of coupling with the flow channel forming member 210. Furthermore, the user may receive the stable gas flow as shaking of the gas flow inside the concentrator 200 is prevented.

The nozzle recession 223 may be located farther from the gas discharger 110 than the nozzle extension 221. Furthermore, the auxiliary protrusion 243 may be located farther from the gas discharger 110 than the auxiliary hook 241. Accordingly, as the auxiliary protrusion 243 is inserted into the nozzle recession 223, the auxiliary hook 241 may be hook-coupled to the nozzle extension 221. That is, the auxiliary protrusion 243 and the nozzle recession 223 may guide the coupling of the auxiliary hook 241 and the nozzle extension 221.

Thus, the auxiliary flow channel forming member 230 may be easily coupled to the flow channel forming member 210. Furthermore, the auxiliary protrusion 243 and the nozzle recession 223 may guide the coupling of the auxiliary hook 241 and the nozzle extension 221, so that damage resulted from the wrong coupling direction of the auxiliary hook 241 and the nozzle extension 221 may be prevented as much as possible.

Furthermore, as the nozzle recession 223 is defined in the inner circumferential surface of the nozzle 211 whose diameter decreases as the distance from the gas discharger 110 increases, an inner circumferential surface of the nozzle recession 223 may be inclined. Both ends of the auxiliary protrusion 243 may be inclined correspondingly. As a result, the auxiliary protrusion 243 and the nozzle recession 223 may be easily coupled to each other, and the great coupling force may be provided.

The nozzle recession 223 may include a plurality of nozzle recessions along the inner circumferential surface of the nozzle 211. Furthermore, the auxiliary protrusion 243 may include a plurality of auxiliary protrusions along the outer circumferential surface of the auxiliary flow channel forming member 230 corresponding to the nozzle recession 223. Specifically, the nozzle recession 223 and the auxiliary protrusion 243 may be disposed symmetrically with respect to the aforementioned one direction C1. This is to avoid the interference with the flow guider 233 as the flow guider 233 may be disposed in parallel with the discharger 213 along the outer circumferential surface of the auxiliary flow channel forming member 230.

Accordingly, the nozzle recession 223 and the auxiliary protrusion 243 may respectively include the plurality of nozzle recessions and the plurality of auxiliary protrusions to increase the coupling force, and the internal space of the nozzle flow channel 280 may be efficiently utilized with efficient arrangement with the flow guider 233.

In one example, the hair dryer 10 may provide the gas flow heated by the temperature adjust unit 120 to the user. The heated gas flow may heat the concentrator 200. When the heated concentrator 200 comes into contact with the user, the user may be injured such as burnt. Accordingly, a heat dissipator or the like for preventing the user injury may be required.

FIG. 10 is a view showing a cover of a concentrator according to one embodiment of the present disclosure. Specifically, (a) in FIG. 10 is a perspective view of the cover, and (b) in FIG. 10 is a view showing the cover viewed in a direction in which the flow channel forming member is inserted.

Referring to FIGS. 7, 8, and 10, the concentrator according to one embodiment of the present disclosure may further include the cover.

Specifically, the concentrator 200 may include a cover 270 that surrounds the flow channel forming member 210 such that the flow channel forming member 210 is located inside. The cover 270 may be disposed to be spaced apart from the flow channel forming member 210. A separation space defined between the cover 270 and the flow channel forming member 210 may dissipate heat of heated gas flowing inside the flow channel forming member 210 to the outside. That is, when use of the hair dryer 10 is stopped, the flow channel forming member 210 and the auxiliary flow channel forming member 230 may rapidly dissipate heat via the separation space defined between the cover 270 and the flow channel forming member 210.

As a result, even when the user comes into contact with the concentrator 200 after using the hair dryer 10, the injury such as the burning may be prevented as much as possible.

Furthermore, the concentrator 200 may include a closing portion 215 extending from the outer circumferential surface of the nozzle 211 toward the cover 270. The closing portion 215 may be disposed at an end of the nozzle 211 facing the gas discharger 110. The closing portion 215 may shield a space between the nozzle 211 and the cover 270, and may be coupled to the cover 270.

An introduction of heated gas into a space between the cover 270 and the flow channel forming member 210 may be prevented by the closing portion 215. Accordingly, the cover 270 may be prevented from being directly heated by heated gas. That is, the cover 270 may be heated slowly compared to the flow channel forming member 210 and the auxiliary flow channel forming member 230.

As a result, even though the user is in contact with the concentrator 200 when using the hair dryer 10, the user may come into contact with the cover 270 located at an outermost portion, and a risk of injury such as the burning may be prevented as much as possible as the user comes into contact with the cover 270, which is heated relatively slowly.

Furthermore, the closing portion 215 may include a magnetic body receiving portion 2151 defined as one surface thereof facing the gas discharger 110 is recessed. As described above, the magnetic body 217 that couples the main body 100 and the concentrator 200 to each other may be received in the magnetic body receiving portion 2151. The magnetic body 217 may be received in the magnetic body receiving portion 2151 and easily coupled to the concentrator 200. Furthermore, the magnetic body 217 may be protected from an external impact.

That is, the closing portion 215 may shield the space between the nozzle 211 and the cover 270 and may receive therein the magnetic body 217 for the coupling of the concentrator 200 and the main body 100. As a result, the closing portion 215 may perform various functions of easily coupling the main body 100 and the concentrator 200 to each other while preventing the user's injury as much as possible. That is, the concentrator 200 may increase efficiency of internal space utilization.

In one example, providing the great coupling force to the cover 270 and the flow channel forming member 210 while facilitating not only the coupling of the auxiliary flow channel forming member 230 and the flow channel forming member 210 described above but also the coupling of the cover 270 and the flow channel forming member 210 is an important factor in durability of the concentrator 200.

Accordingly, the concentrator 200 according to an embodiment of the present disclosure may include a coupling portion for the coupling of the cover 270 and the flow channel forming member 210.

Referring to FIGS. 7, 8, and 10, the cover 270 may include a cover protrusion 275 protruding from an inner circumferential surface of the cover 270 toward the outer circumferential surface of the nozzle 211. The cover protrusion 275 may be formed as one surface of the cover 270 is recessed. That is, the cover protrusion 275 may include a cover protrusion extension 2751 extending from the inner circumferential surface of the cover 270.

Furthermore, the cover protrusion 275 may include a cover protrusion recession 2753 defined as one surface of the cover protrusion extension 2751 is recessed. One surface of the cover protrusion extension 2751 may be a first cover protrusion extension surface 2751*a* facing the outside and a second cover protrusion extension surface 2751*b* facing the gas discharger. That is, the cover protrusion recession 2753 may be defined in the first cover protrusion extension surface 2751*a*.

The closing portion 215 may include a closing hook 2153 extending from one surface of the closing portion 215 toward the cover protrusion 275. The one surface of the closing portion 215 may be a first closing surface 215*a* among the first closing surface 215*a* facing the outside and a second closing surface 215*b* facing the gas discharger. That is, the closing hook 2153 may be disposed on the first closing surface 215*a*. An end of the closing hook 2153 may protrude and may be inserted into and coupled to the cover protrusion 275.

Specifically, the closing hook 2153 may include a closing hook extension 2153*a* extending from the closing portion 215. Furthermore, the closing hook 2153 may include a closing hook protrusion 2153*b* protruding from the closing hook extension 2153*a* toward the inner circumferential surface of the cover 270. The closing hook protrusion 2153*b* may be inserted into and coupled to the cover protrusion recession 2753.

Thus, the flow channel forming member 210 may be inserted into the cover 270 and may be easily fixed by being spaced apart from the flow channel forming member 210 via the cover protrusion 275 and the closing hook 2153. That is, because the flow channel forming member 210 may be coupled to the cover 270 without the need for the separate bolt fastening, adhesive, or welding, the manufacturing process may be simplified. Furthermore, because the separate member or process for the fixing is omitted, the economic efficiency may be increased. Furthermore, the cover protrusion recession 2753 may prevent the closing hook protrusion 2153*b* from being separated as much as possible, so that the coupling force between the cover 270 and the flow channel forming member 210 may be increased.

The cover protrusion 275 may include a plurality of cover protrusions along the inner circumferential surface of the cover 270. Furthermore, the closing hook 2153 may include a plurality of closing hooks along the outer circumferential surface of the flow channel forming member 210 corresponding to the cover protrusion 275. Specifically, the cover protrusion 275 and the closing hook 2153 may be disposed symmetrically with respect to the aforementioned one direction C1. This is to efficiently utilize the space as a discharger cover 273, which will be described later, may extend into the nozzle cover 271.

As a result, the cover protrusion 275 and the closing hook 2153 may respectively include the plurality of cover protrusions and the plurality of closing hooks 2153 to increase the coupling force, and the cover protrusion 275 and closing hook 2153 may be efficiently arranged to efficiently utilize the internal space of the concentrator 200.

The cover 270 may include the nozzle cover 271 formed in a shape corresponding to the nozzle 211. Furthermore, the cover 270 may include the discharger cover 273 extending from the nozzle cover 271 and formed in a shape corresponding to the discharger 213. This is to keep the cover 270 spaced apart from the flow channel forming member 210 by a predetermined distance while minimizing an overall volume of the concentrator 200. Furthermore, this is to efficiently protect the flow channel forming member 210 and the auxiliary flow channel forming member 230 located inside the cover 270 via the cover 270.

In one example, when the flow channel forming member 210 is inserted into and coupled to the cover 270, the cover 270 needs to prevent unnecessary impact resulted from the wrong coupling direction of the cover protrusion 275 and the closing hook 2153 as much as possible to increase durability of the cover protrusion 275 and the auxiliary hook 241.

Accordingly, the cover 270 may include a cover protruding guider 2731 protruding from an inner circumferential surface of the discharger cover 273. Furthermore, the flow channel forming member 210 may include a discharge guider 2131 protruding from an outer circumferential surface of the discharger 213. The cover protruding guider 2731 and the discharge guider 2131 may be disposed at locations corresponding to each other so as to be in contact with each other.

Furthermore, one end of the cover protruding guider 2731 may be curved. The one end of the cover protrusion guider 2731 may come into contact with an end of the discharge guider 2131. That is, the one end of the cover protruding guider 2731 may serve as a stopper when the flow channel forming member 210 is inserted into and coupled to the cover 270. Accordingly, the flow channel forming member 210 may be inserted into the cover 270 along the cover protrusion guider 2731 via the discharge guider 2131 and coupled to the cover 270.

Specifically, the cover protruding guider 2731 may include a cover guider extension 2731*a* extending from one end thereof facing the outside to the other end facing the gas discharger 110. Furthermore, the cover protruding guider 2731 may include a cover guider protrusion 2731*b* protruding from one end of the cover guider extension 2731*a* to be inclined with respect to an extension direction of the cover guider extension 2731*a*. Accordingly, the discharge guider 2131 may be inserted into the discharger cover 273 along the cover guider extension 2731*a* to a point where the discharge guider 2131 comes into contact with the cover guide protrusion 2731*b*.

As a result, the unnecessary impact resulted from the wrong coupling direction of the cover protrusion 275 and the closing hook 2153 may be prevented as much as possible. Furthermore, excessive insertion of the flow channel forming member 210 into the cover 270 may be prevented by the cover guider protrusion 2731*b*. That is, structural safety inside the concentrator 200 may be increased.

The cover protruding guider 2731 may include a plurality of cover protruding guiders along the inner circumferential surface of the discharger cover 273. Furthermore, the discharge guider 2131 may include a plurality of discharge guiders along the outer circumferential surface of the discharger 213 corresponding to the cover protruding guider 2731. Accordingly, the cover protruding guider 2731 and the discharge guider 2131 may respectively include the plurality of cover protruding guider and the plurality of discharge guiders to more easily guide the coupling of the flow channel forming member 210 and the cover 270.

As described above, the length of the discharger 213 in the one direction C1 may be greater than the length thereof in the other direction C2. That is, the discharger 213 may include a first discharger surface 213*a* extending in the one direction C1. Furthermore, the discharger 213 may include a second discharger surface 213*b* that faces the first discharger surface 213*a* and extends in the one direction C1. Furthermore, the discharger 213 may include a third discharger surface 213*c* extending in the other direction C2 while connecting the first discharger surface 213*a* and the second discharger surface 213*b* to each other. Furthermore, the discharger 213 may include a fourth discharger surface 214*d* extending in the other direction C2 while facing the third discharger surface 213*c* and connecting the first discharge surface 213*a* and the second discharge surface 213*b* to each other.

Furthermore, as described above, the discharger cover 273 may be formed in the shape corresponding to the discharger 213. That is, the discharger cover 273 may include a first discharger cover surface 273*a* extending in the one direction C1. Furthermore, the discharger cover 273 may include a second discharger cover surface 273*b* facing the first discharge cover surface 273*a* and extending in the one direction C1. Furthermore, the discharger cover 273 may include a third discharger cover surface 273*c* extending in the other direction C2 while connecting the first discharger cover surface 273*a* and the second discharger cover surface 273*b* to each other. Furthermore, the discharger cover 273 may include a fourth discharger cover surface 273*d* extending in the other direction C2 while facing the third discharger cover surface 273*c* and connecting the first discharger cover surface 273*a* and the second discharger cover surface 273*b* to each other.

Accordingly, the first discharger surface 213*a* and the second discharger surface 213*b* may have cross-sectional areas larger than those of the third discharger surface 213*c* and the fourth discharger surface 214*d*. Furthermore, the first discharger cover surface 273*a* and the second discharger cover surface 273*b* may have cross-sectional areas larger than those of the third discharger cover surface 273*c* and the fourth discharger cover surface 273*d*. The discharge guider 2131 may include a plurality of discharge guiders on each of the first discharger surface 213*a* and the second discharger surface 213*b*. Furthermore, the cover protruding guider 2731 may include a plurality of cover protruding guiders on each of the first discharger cover surface 273*a* and the second discharger cover surface 273*b*. That is, even when the discharge guider 2131 and the cover protruding guider 2731 respectively include the plurality of discharge guiders and the plurality of cover protruding guiders, a sufficient space therefor may be secured. As a result, in the concentrator 200, the flow channel forming member 210 and the cover 270 may be easily coupled to each other while efficiently utilizing the internal space.

In one example, as described above, the gas discharger 110 may include the center hole 115 defined at the center of the gas discharger 110 to discharge gas. Furthermore, the side hole 113 defined in the ring shape surrounding the center hole 115 and through which gas is discharged may be included. Gas passing through the center hole 115 and the side hole 113 may be entirely guided to the nozzle flow channel 280 and discharged to the outside. However, the gas that has passed through the center hole 115 may be guided into the auxiliary flow channel forming member 230 to form a vortex. Furthermore, the gas that has passed through the center hole 115 may pressurize the inside of the auxiliary flow channel forming member 230 in the direction away from the gas discharger to separate the concentrator 200 from the main body 100.

Accordingly, the auxiliary flow channel forming member 230 may include a communication hole 231 defined through a center of the auxiliary flow channel forming member 230. The communication hole 231 may allow the inside of the auxiliary flow channel forming member 230 and the discharger 213 to be in communication with each other. Accordingly, gas flowing into the auxiliary flow channel forming member 230 from the center hole 115 may be guided to the discharger 213 via the communication hole 231.

In other words, an internal flow channel 285 may be formed inside the auxiliary flow channel forming member 230. The internal flow channel 285 may be in communication with the discharger 213 via the communication hole 231. Gas that has passed through the internal flow channel 285 may be guided to the discharger 213 via the communication hole 231.

Thus, the formation of the vortex of gas introduced into the auxiliary flow channel forming member 230 may be prevented as much as possible. Furthermore, the separation of the concentrator 200 from the main body 100 by gas introduced into the auxiliary flow channel forming member 230 may be prevented as much as possible.

Further, as the gas flow that has passed through the internal passage 285 and the nozzle flow channel 280 is integrated in the discharger flow channel 290, the concentration of gas may be facilitated. That is, concentrated gas may be provided to the user. Furthermore, the internal flow path 285 and the nozzle flow channel 280 may have different shapes, cross-sectional areas, lengths, and the like. That is, the gas flow with various characteristics may be provided to the user. The user may receive the three-dimensional gas flow via the nozzle flow channel 280 and the internal passage 285.

FIG. 11 is a view showing a process of coupling a flow channel forming member and an auxiliary flow channel forming member to each other according to an embodiment of the present disclosure. Specifically, (a) in FIG. 11 is a view showing that the flow channel forming member 210 and the auxiliary flow channel forming member 230 are spaced apart from each other, (b) in FIG. 11 is a view showing that the flow channel forming member 210 and the auxiliary flow channel forming member 230 are in contact with and coupled to each other, and (c) in FIG. 11 is a view showing that the coupling of the flow channel forming member 210 and the auxiliary flow channel forming member 230 is completed.

Referring to FIG. 11, in the process of coupling the flow channel forming member and the auxiliary flow channel forming member to each other, as the auxiliary flow channel forming member 230 is inserted into the flow channel forming member 210, the auxiliary protrusion 243 may start to be inserted into the nozzle recession 223. In this regard, the auxiliary hook 241 may be in contact with the nozzle extension 221.

As the auxiliary protrusion 243 is gradually inserted into the nozzle recession 223, the auxiliary hook 241 may be pressurized by the nozzle extension 221. Accordingly, an end of the auxiliary hook 241 may be moved toward the center of the nozzle 211.

When the insertion of the auxiliary protrusion 243 into the nozzle recession 223 is completed, the end of the auxiliary hook 241 may come into contact with and hook-coupled to one surface of the nozzle extension 221 facing the outside. As a result, the coupling of the flow channel forming member 210 and the auxiliary flow channel forming member 230 may be completed.

Furthermore, although not shown in the drawings, when the cover 270 and the flow channel forming member 210 are coupled to each other, the closing hook 2153 and the cover protrusion 275 may be coupled to each other in the same manner as the auxiliary hook 241 and the nozzle extension 221 are coupled to each other.

FIG. 12 is a perspective view of a concentrator according to another embodiment of the present disclosure. FIG. 13 is a cross-sectional view of a concentrator according to another embodiment of the present disclosure. FIG. 14 is a view showing a flow channel forming member of a concentrator according to another embodiment of the present disclosure. FIG. 15 is a view showing an auxiliary flow channel forming member of a concentrator according to another embodiment of the present disclosure.

Specifically, (a) in FIG. 13 is a cross-sectional view of a state in which the flow channel forming member, the auxiliary flow channel forming member, and the cover are coupled to each other, and (b) in FIG. 13 is a cross-sectional view of a state in which the flow channel forming member, the auxiliary flow channel forming member, and the cover are separated from each other.

(a) in FIG. 14 is a perspective view of the flow channel forming member, (b) in FIG. 14 is a view showing the flow channel forming member viewed from one surface of the flow channel forming member facing the gas discharger, and (c) in FIG. 14 is a view showing the flow channel forming member viewed from a side opposite to the side of (b) in FIG. 14.

(a) in FIG. 15 is a perspective view of the auxiliary flow channel forming member, and (b) in FIG. 15 is a view showing the auxiliary flow channel forming member viewed from one surface of the auxiliary flow channel forming member located far from the gas discharger.

Referring to FIGS. 12 to 15, a concentrator according to another embodiment of the present disclosure will be described. A description of contents duplicated with the above-mentioned contents of contents to be described later will be omitted. However, the omitted contents should not be construed as limiting.

The nozzle coupling portion 220 may include a central coupling portion 225 extending from the center of the nozzle 211 toward the gas discharger 110. The auxiliary coupling portion 240 may include a central recession 245 defined to be recessed at a center of the auxiliary flow channel forming member 230. The central recession 245 may be defined in a shape corresponding to the central coupling portion 225. Accordingly, the central coupling portion 225 may be inserted into and coupled to the central recession. That is, the nozzle flow channel 280 may be formed in the central coupling portion 225 by allowing the flow channel forming member 210 and the auxiliary flow channel forming member 230 to be spaced apart from each other. Furthermore, the central coupling portion 225 may fix the flow channel forming member 210 and the auxiliary flow channel forming member 230.

As a result, the auxiliary flow channel forming member 230 may be inserted into the flow channel forming member 210 and may be easily fixed by being spaced apart from the flow channel forming member 210 by the central coupling portion 225 and the central recession 245. That is, because the auxiliary flow channel forming member 230 may be coupled to the flow channel forming member 210 without the need for the separate bolt fastening, adhesive, or welding, the manufacturing process may be simplified. Furthermore, because the separate member or process for the fixing is omitted, the economic efficiency may be increased.

The central coupling portion 225 may include a central extension 2253 extending from a portion where the nozzle 211 and the discharger 213 come into contact with each other. Furthermore, the central coupling portion 225 may include a central inserted portion 2255 extending from the central extension 2253 and having a larger diameter than the central extension 2253. The central inserted portion 2255 may be inserted into and coupled to the central recession 245.

Accordingly, the central inserted portion 2255 may be fixed to the central recession 245 and may be prevented from being separated even when the force is applied in the direction toward the gas discharger 110 and in the direction away from the gas discharger 110. Accordingly, the auxiliary flow channel forming member 230 may receive the great force of coupling with the flow channel forming member 210 by the central inserted portion 2255 and the central recession 245.

Furthermore, the central coupling portion 225 may include a cutout 2257 defined as a portion of the central inserted portion 2255 is cut. That is, the central inserted portion 2255 may have a circular cross-section but may be formed intermittently. The cutout 2257 may facilitate elastic deformation of the central inserted portion 2255 when the central inserted portion 2255 is inserted into the central recession 245. Furthermore, the cutout 2257 may prevent the flow guider 233 and the central inserted portion 2255 from being in contact with each other. Thus, the central coupling portion 225 may be easily coupled to the central recession 245 via the cutout 2257.

In one example, as described above, the gas discharger 110 may include the center hole 115 defined at the center of the gas discharger 110 to discharge gas. Furthermore, the gas discharger 110 may include the side hole 113 defined in the ring shape surrounding the center hole 115 and through which gas is discharged. Gas passing through the center hole 115 and the side hole 113 may entirely be guided to the nozzle flow channel 280 and discharged to the outside. However, gas that has passed through the center hole 115 may be guided into the auxiliary flow channel forming member 230 to form the vortex. Furthermore, the gas that has passed through the center hole 115 may pressurize the inside of the auxiliary flow channel forming member 230 in the direction away from the gas discharger to separate the concentrator 200 from the main body 100.

Accordingly, the central coupling portion 225 may include a central coupling communication hole 2251 defined through a center of the central coupling portion 225. Furthermore, the central recession 245 may include a central recession communication hole 2451 defined through a center of the central recession 245. The central coupling communication hole 2251 and the central recession communication hole 2451 may be in communication with each other when the central coupling portion 225 is inserted into and coupled to the central recession 245. Accordingly, the central coupling communication hole 2251 and the central recession communication hole 2451 may allow the inside of the auxiliary flow channel forming member 230 and the discharger 213 to be in communication with each other. Further, gas flowing into the auxiliary flow channel forming member 230 from the center hole 115 may be guided to the discharger 213 via the central coupling communication hole 2251 and the central recession communication hole 2451.

In other words, the internal flow channel 285 may be formed inside the auxiliary flow channel forming member 230. The internal flow channel 285 may be in communication with the discharger 213 via the central coupling communication hole 2251 and the central recession communication hole 2451. Gas that has passed through the internal flow channel 285 may be guided to the discharger 213 via the central coupling communication hole 2251 and the central recession communication hole 2451.

Thus, the formation of the vortex of gas introduced into the auxiliary flow channel forming member 230 may be prevented as much as possible. Furthermore, the separation of the concentrator 200 from the main body 100 by gas introduced into the auxiliary flow channel forming member 230 may be prevented as much as possible.

Further, as the gas flow that has passed through the internal flow channel 285 and the nozzle flow channel 280 is integrated in the discharger flow channel 290, the concentration of gas may be more easily performed. That is, concentrated gas may be provided to the user. Furthermore, the internal flow channel 285 and the nozzle flow channel 280 may have the different shapes, cross-sectional areas, lengths, and the like. That is, the gas flows with the various characteristics may be provided to the user. The user may receive the three-dimensional gas flow via the nozzle flow channel 280 and the internal flow channel 285.

In one example, in the auxiliary flow channel forming member 230, the flow guider 233 may be disposed along the outer circumferential surface of the auxiliary flow channel forming member 230. That is, the flow guider 233 may extend from the one end of the auxiliary flow channel forming member 230 facing the gas discharger 110 to the other end thereof facing the outside. Furthermore, the flow guider 233 may be disposed in parallel with the discharger 213. Furthermore, the diameter of the flow guider 233 may decrease as the distance from the gas discharger 110 increases. That is, the flow guider 233 may be formed in the thin wing shape.

Furthermore, flow guider 233 may extend to surround the central recession 245. Further, the flow guider 233 may more protrude in the direction away from the gas discharger 110 than the central recession 245. Accordingly, the flow guider 233 may be coupled to the central extension 2253. Thus, gas flowing through the nozzle flow channel 280 may be stably guided toward the discharger 213 via the flow guider 233. Furthermore, the flow guider 233 may be disposed in parallel with the discharger 213 to give the directionality of coupling when the auxiliary flow channel forming member 230 is inserted into the flow channel forming member 210. Furthermore, the flow guider 233 may assist in coupling the central coupling portion 225 and the central recession 245.

In one example, to further increase the force of coupling of the flow channel forming member 210 and the auxiliary flow channel forming member 230, the nozzle coupling portion 220 may include a nozzle protrusion 224 protruding from the inner circumferential surface of the nozzle 211. The nozzle protrusion 224 may protrude toward the outer circumferential surface of the flow channel forming member 210. Furthermore, the auxiliary coupling portion 240 may include an auxiliary recession 244 defined by being recessed in the outer circumferential surface of the auxiliary flow channel forming member 230. The auxiliary recession 244 may be defined at a location corresponding to the nozzle protrusion 224. The nozzle protrusion 224 may be inserted into and coupled to the auxiliary recession 244. As a result, the concentrator 200 may increase the force of coupling of the flow channel forming member 210 and the auxiliary flow channel forming member 230 via the nozzle protrusion 224 and the auxiliary recession 244.

The nozzle protrusion 224 may include a plurality of nozzle protrusions along the inner circumferential surface of the nozzle 211. Furthermore, the auxiliary recession 244 may include a plurality of auxiliary recessions along the outer circumferential surface of the flow channel forming member 210 corresponding to the nozzle protrusion 224.

Specifically, the nozzle protrusion 224 and the auxiliary recession 244 may be disposed symmetrically with respect to the aforementioned one direction C1. This is to efficiently utilize the space as the discharger 213 extends into the cover 270.

As a result, the nozzle protrusion 224 and the auxiliary recession 244 may respectively include the plurality of nozzle protrusions and the plurality of auxiliary recessions to increase the coupling force, and the nozzle protrusion 224 and auxiliary recession 244 may be efficiently arranged to efficiently utilize the internal space of the concentrator 200.

Furthermore, the number of nozzle protrusions 224 and the number of auxiliary recessions 244 may be equal to or greater than four to provide the greater coupling force, and the nozzle protrusion 224 and the auxiliary recession 244 may be disposed symmetrically with respect to the other direction C2 described above. However, as described above, the discharger 213 may extend into the nozzle 211. Accordingly, an angle formed by the nozzle protrusion 224 based on an imaginary line F extending in the other direction C2 may be limited to be within a certain range. Furthermore, an angle formed by the auxiliary recession 244 based on the imaginary line F extending in the other direction C2 may be limited to be within a certain range. For example, the angle may be limited to be equal to or smaller than 45 degrees. As a result, a resistance of the gas flow concentrated in the discharger 213 may be prevented from being generated as much as possible.

In one example, the hair dryer 10 may provide the gas flow heated by the temperature adjust unit 120 to the user.

The heated gas flow may heat the concentrator 200. When the heated concentrator 200 comes into contact with the user, the user may be injured such as burnt. Accordingly, the heat dissipator or the like for preventing the user's injury may be required.

FIG. 16 is a view showing a cover of a concentrator according to an embodiment of the present disclosure. Specifically, (a) in FIG. 16 is a perspective view of the cover, and (b) in FIG. 16 is a view showing the cover viewed in the direction in which the flow channel forming member is inserted.

Referring to FIGS. 13, 14, and 16, the concentrator according to one embodiment of the present disclosure may further include the cover.

Specifically, the concentrator 200 may include the cover 270 that surrounds the flow channel forming member 210 such that the flow channel forming member 210 is located therein. The cover 270 may be spaced apart from the flow channel forming member 210. The separation space defined between the cover 270 and the flow channel forming member 210 may dissipate the heat of heated gas flowing inside the flow channel forming member 210 to the outside. That is, when the use of the hair dryer 10 is stopped, the flow channel forming member 210 and the auxiliary flow channel forming member 230 may rapidly dissipate the heat via the separation space defined between the cover 270 and the flow channel forming member 210.

As a result, even when the user comes into contact with the concentrator 200 after using the hair dryer 10, the injury such as the burning may be prevented as much as possible.

Furthermore, the concentrator 200 may include the closing portion 215 extending from the outer circumferential surface of the nozzle 211 toward the cover 270. The closing portion 215 may be disposed at the end of the nozzle 211 facing the gas discharger 110. The closing portion 215 may shield the space between the nozzle 211 and the cover 270, and may be coupled to the cover 270.

Heated gas may be prevented from being introduced into the space between the cover 270 and the flow channel forming member 210 via the closing portion 215. Accordingly, the cover 270 may be prevented from being directly heated by heated gas. That is, even when the cover 270 is heated, the cover 270 may be heated slowly compared to the flow channel forming member 210 and the auxiliary flow channel forming member 230.

As a result, even when the user may come into contact with the concentrator 200 when using the hair dryer 10, the user may come into contact with the cover 270 located at the outermost portion. Because the user comes into contact with the cover 270, which is heated relatively slowly, the risk of injury such as the burning may be prevented as much as possible.

Furthermore, the closing portion 215 may include the magnetic body receiving portion 2151 defined as one surface thereof facing the gas discharger 110 is recessed. As described above, the magnetic body 217 that couples the main body 100 and the concentrator 200 to each other may be received in the magnetic body receiving portion 2151. The magnetic body 217 may be received in the magnetic body receiving portion 2151 and easily coupled to the concentrator 200. Furthermore, the magnetic body 217 may be protected from the external impact.

That is, the closing portion 215 may shield the space between the nozzle 211 and the cover 270 and may receive therein the magnetic body 217 for the coupling of the concentrator 200 and the main body 100. As a result, the closing portion 215 may perform the various functions of easily coupling the main body 100 and the concentrator 200 to each other while preventing the user's injury as much as possible. That is, the concentrator 200 may increase the efficiency of internal space utilization.

In one example, providing the great coupling force to the cover 270 and the flow channel forming member 210 while facilitating not only the coupling of the auxiliary flow channel forming member 230 and the flow channel forming member 210 described above but also the coupling of the cover 270 and the flow channel forming member 210 is the important factor in durability of the concentrator 200.

Accordingly, the concentrator 200 according to the embodiment of the present disclosure may include the coupling portion for the coupling of the cover 270 and the flow channel forming member 210.

Referring to FIGS. 13, 14, and 16, the cover 270 may include a cover receiving portion 277 extending from the inner circumferential surface of the cover 270 toward the closing portion 215. The cover receiving portion 277 may be defined as one surface of the cover is recessed. That is, the cover protrusion 275 may include a cover receiving extension 2771 extending from the inner circumferential surface of the cover 270.

Furthermore, the cover receiving portion 277 may include a cover receiving recession 2773 defined as one surface of the cover receiving extension 2771 is recessed. One surface of the cover receiving extension 2771 may be a first cover receiving extension surface 2771*a* among the first cover receiving extension surface 2771*a* facing the inner circumferential surface of the cover 270 and a second cover receiving extension surface 2771*b* facing the outer circumferential surface of the flow channel forming member 210. That is, the cover receiving recession 2773 may be defined in the first cover receiving extension surface 2771*a*.

The closing portion 215 may include a closing coupling portion 2155 extending from one surface of the closing portion 215 toward the cover receiving portion 277. One surface of the closing portion 215 may be the first closing surface 215*a* among the first closing surface 215*a* facing the outside and the second closing surface 215*b* facing the gas discharger. That is, the closing coupling portion 2155 may be disposed on the first closing surface 215*a*. An end of the closing coupling portion 2155 may protrude and may be inserted into and coupled to the cover receiving portion 277.

Specifically, the closing coupling portion 2155 may include a closing coupling extension 2155*a* extending from the closing portion 215. Furthermore, the closed coupling portion 2155 may include a closing coupling protrusion 2155*b* protruding from the closing coupling extension 2155*a* toward the outer circumferential surface of the nozzle 211. The closing coupling protrusion 2155*b* may be inserted into and coupled to the cover receiving recession 2773.

Thus, the flow channel forming member 210 may be inserted into the cover 270 and may be easily fixed by being spaced apart from the flow channel forming member 210 by the cover receiving portion 277 and the closing coupling portion 2155. That is, because the flow channel forming member 210 may be coupled to the over 270 without the need for the separate bolt fastening, adhesive, or welding, the manufacturing process may be simplified. Furthermore, because the separate member or process for the fixing is omitted, the economic efficiency may be increased. Further, the cover receiving recession 2773 may prevent the closing coupling protrusion 2155*b* from being separated as much as possible, so that the force of coupling between the cover 270 and the flow channel forming member 210 may be increased.

The cover receiving portion 277 may include a plurality of cover receiving portions along the inner circumferential surface of the cover 270. Furthermore, the closing coupling portion 2155 may include a plurality of closing coupling portions along the outer circumferential surface of the flow channel forming member 210 corresponding to the cover receiving portion 277.

Specifically, the cover receiving portion 277 and the closing coupling portion 2155 may be disposed symmetrically with respect to the aforementioned one direction C1. This is to efficiently utilize the space as the discharger cover 273, which will be described later, may extend into the nozzle cover 271.

Thus, the cover receiving portion 277 and the closing coupling portion 2155 may respectively include the plurality of cover receiving portions and the plurality of closing coupling portions to increase the coupling force, and the cover receiving portion 277 and the closed coupling portion 2155 may be efficiently arranged to efficiently utilize the internal space of the concentrator 200.

Furthermore, the number of cover receiving portions 277 and the number of closing coupling portions 2155 may be equal to or greater than four to provide the greater coupling force, and the cover receiving portion 277 and the closing coupling portion 2155 may be disposed symmetrically with respect to the other direction C2 described above.

The cover 270 may include the nozzle cover 271 formed in the shape corresponding to the nozzle 211. Furthermore, the cover 270 may include the discharger cover 273 extending from the nozzle cover 271 and formed in the shape corresponding to the discharger 213. This is to keep the cover 270 spaced apart from the flow channel forming member 210 by the predetermined distance while minimizing the overall volume of the concentrator 200. Furthermore, this is to efficiently protect the flow channel forming member 210 and the auxiliary flow channel forming member 230 located inside the cover 270 via the cover 270.

In one example, when the flow channel forming member 210 is inserted into and coupled to the cover 270, the cover 270 needs to prevent unnecessary impact resulted from the wrong coupling direction of the cover receiving portion 277 and the closing coupling portion 2155 as much as possible to increase durability of the cover receiving portion 277 and the closing coupling portion 2155.

Accordingly, the cover 270 may include a cover recessed guider 2733 recessed from the inner circumferential surface of the discharger cover 273. Furthermore, the flow channel forming member 210 may include a discharge guide 2133 protruding from the outer circumferential surface of the discharger 213. The discharge guide 2133 may be disposed at a location corresponding to the cover recessed guider 2733 so as to be inserted thereinto.

Furthermore, one end of the discharge guide 2133 may be in contact with one end of the cover recess guider 2733 positioned far from the gas discharger 110. That is, the one end of the cover protruding guider 2731 may serve as the stopper when the flow channel forming member 210 is inserted into and coupled to the cover 270. Accordingly, the flow channel forming member 210 may be inserted into the cover 270 along the cover recessed guider 2733 via the discharge guide 2133 and coupled to the cover 270.

As a result, the unnecessary impact resulted from the wrong coupling direction of the cover receiving portion 277 and the auxiliary hook 241 may be prevented as much as possible. Furthermore, the excessive insertion of the flow channel forming member 210 into the cover 270 may be prevented by the cover receiving portion 277. That is, the structural safety inside the concentrator 200 may be increased.

The cover recessed guider 2733 may include a plurality of cover recessed guiders along the inner circumferential surface of the discharger cover 273. Furthermore, the discharge guide 2133 may include a plurality of discharge guides along the outer circumferential surface of the discharger 213 corresponding to the cover recessed guider 2733. Accordingly, the cover recessed guider 2733 and the discharge guide 2133 may respectively include the plurality of cover recessed guiders and the plurality of discharge guides to more easily guide the coupling of the flow channel forming member 210 and the cover 270.

As described above, the length of the discharger 213 in the one direction C1 may be greater than the length thereof in the other direction C2. That is, the discharger 213 may include the first discharger surface 213*a* extending in the one direction C1. Furthermore, the discharger 213 may include the second discharger surface 213*b* that faces the first discharger surface 213*a* and extends in the one direction C1. Furthermore, the discharger 213 may include the third discharger surface 213*c* extending in the other direction C2 while connecting the first discharger surface 213*a* and the second discharger surface 213*b* to each other. Furthermore, the discharger 213 may include the fourth discharger surface 214*d* extending in the other direction C2 while facing the third discharger surface 213*c* and connecting the first discharge surface 213*a* and the second discharge surface 213*b* to each other.

Furthermore, as described above, the discharger cover 273 may be formed in the shape corresponding to the discharger 213. That is, the discharger cover 273 may include the first discharger cover surface 273*a* extending in the one direction C1. Furthermore, the discharger cover 273 may include the second discharger cover surface 273*b* facing the first discharge cover surface 273*a* and extending in the one direction C1. Furthermore, the discharger cover 273 may include the third discharger cover surface 273*c* extending in the other direction C2 while connecting the first discharger cover surface 273*a* and the second discharger cover surface 273*b* to each other. Furthermore, the discharger cover 273 may include the fourth discharger cover surface 273*d* extending in the other direction C2 while facing the third discharger cover surface 273*c* and connecting the first discharger cover surface 273*a* and the second discharger cover surface 273*b* to each other.

Accordingly, the first discharger surface 213*a* and the second discharger surface 213*b* may have the cross-sectional areas larger than those of the third discharger surface 213*c* and the fourth discharger surface 214*d*. Furthermore, the first discharger cover surface 273*a* and the second discharger cover surface 273*b* may have the cross-sectional areas larger than those of the third discharger cover surface 273*c* and the fourth discharger cover surface 273*d*. The discharge guide 2133 may include a plurality of discharge guides on each of the first discharger surface 213*a* and the second discharger surface 213*b*. Furthermore, the cover recessed guider 2733 may include a plurality of cover recessed guiders on each of the first discharger cover surface 273*a* and the second discharger cover surface 273*b*. That is, even when the discharge guider 2131 and the cover protruding guider 2731 respectively include the plurality of discharge guiders and the plurality of cover protruding guiders, the sufficient space therefor may be secured. As a result, in the concentrator 200, the flow channel forming member 210 and the cover 270 may be easily coupled to each other while efficiently utilizing the internal space.

Furthermore, each of the third discharger surface 213*c* and the fourth discharger surface 214*d* may have an auxiliary discharge guide 2135. The auxiliary discharge guides 2135 may respectively protrude from the third discharger surface 213*c* and the fourth discharger surface 214*d*. Furthermore, the singular auxiliary discharge guide 2135 may be disposed on each of the third discharger surface 213*c* and the fourth discharger surface 214*d*. This is because the cross-sectional areas of the third discharger surface 213*c* and the fourth discharger surface 214*d* are relatively smaller than those of the first discharger surface 213*a* and the second discharger surface 213*b*.

Furthermore, each of the third discharger cover surface 273*c* and the fourth discharger cover surface 273*d* may have a cover recessed auxiliary guider 2735. The cover recessed auxiliary guiders 2735 may respectively protrude from the third discharger cover surface 273*c* and the fourth discharger cover surface 273*d*. Furthermore, the cover recessed auxiliary guider 2735 may be defined as one surface is recessed. Furthermore, the singular cover recessed auxiliary guider 2735 may be disposed on each of the third discharger cover surface 273*c* and the fourth discharger cover surface 273*d*. This is because the cross-sectional areas of the third discharger cover surface 273*c* and the fourth discharger cover surface 273*d* are relatively smaller than those of the first discharger cover surface 273*a* and the second discharger cover surface 273*b*.

As a result, the auxiliary discharge guide 2135 may be inserted into the cover recessed auxiliary guider 2735 to efficiently guide the coupling of the flow channel forming member 210 and the cover 270. That is, the cover recessed auxiliary guider 2735 and the auxiliary discharge guide 2135 may assist the cover recessed guider 2733 and the discharge guide 2133 to guide the coupling of the flow channel forming member 210 and the cover 270.

FIG. 17 is a view showing a process of coupling a flow channel forming member and an auxiliary flow channel forming member to each other according to another embodiment of the present disclosure. Specifically, (a) in FIG. 17 is a view showing that the flow channel forming member 210 and the auxiliary flow channel forming member 230 are spaced apart from each other, (b) in FIG. 17 is a view showing that the flow channel forming member 210 and the auxiliary flow channel forming member 230 are in contact with and coupled to each other, and (c) in FIG. 17 is a view showing that the coupling of the flow channel forming member 210 and the auxiliary flow channel forming member 230 is completed.

The process of coupling the flow channel forming member and the auxiliary flow channel forming member to each other will be described with reference to FIG. 17. As the auxiliary flow channel forming member 230 is inserted into the flow channel forming member 210, the central coupling portion 225 may start to be inserted into the central recession 245. In this regard, the nozzle protrusion 224 may start to be inserted into the auxiliary recession 244.

As the central coupling portion 225 is gradually inserted into the central recession 245, the central coupling portion 225 may be pressurized by the inner circumferential surface of the central recession 245. Accordingly, an end of the central coupling portion 225 may be moved toward a center of the nozzle 211. Furthermore, the nozzle protrusion 224 may be further inserted into the auxiliary recession 244.

When the insertion of the central coupling portion 225 into the central recession 245 is completed, the insertion of the nozzle protrusion 224 into the auxiliary recession 244 may be completed. As a result, the coupling of the flow channel forming member 210 and the auxiliary flow channel forming member 230 may be completed. Because the central coupling portion 225 is supported by the central recession 245, separation of the flow channel forming member 210 and the auxiliary flow channel forming member 230 may be prevented as much as possible. Furthermore, the nozzle protrusion 224 and the auxiliary recession 244 may fix the flow channel forming member 210 and the auxiliary flow channel forming member 230 together with the central coupling portion 225 and the central recession 245.

FIG. 18 is a view showing a process of coupling a flow channel forming member and a cover to each other according to another embodiment of the present disclosure. Specifically, (a) in FIG. 11 is a view showing that the flow channel forming member 210 and the cover 270 are spaced apart from each other, (b) in FIG. 11 shows that the flow channel forming member 210 and the cover 270 are in contact with and coupled to each other, and (c) in FIG. 11 is a view showing that the coupling of the flow channel forming member 210 and the cover 270 is completed.

The process of coupling the flow channel forming member and the cover to each other will be described with reference to FIG. 18. As the flow channel forming member 210 is inserted into the cover 270, the closing coupling portion 2155 may come into contact with the cover receiving portion 277.

When the flow channel forming member 210 is inserted into the cover 270, the closing coupling portion 2155 may pressurize the cover receiving portion 277. Furthermore, the cover receiving portion 277 may pressurize the closing coupling portion 2155. Accordingly, an end of the cover receiving portion 277 may be moved toward the center of the nozzle cover 271. Furthermore, the end of the closing coupling portion 2155 may be moved away from the center of the nozzle 211.

When the flow channel forming member 210 is further inserted into the cover 270, the end of the closing coupling portion 2155 may be inserted into the cover receiving recession 2773 of the cover receiving portion 277. As a result, the coupling of the flow channel forming member 210 and the auxiliary flow channel forming member 230 may be completed.

FIG. 19 is a view showing a concentrator according to another embodiment of the present disclosure. FIG. 20 is a view showing a flow channel forming member of a concentrator according to another embodiment of the present disclosure. FIG. 21 is a view showing an auxiliary flow channel forming member of a concentrator according to another embodiment of the present disclosure.

Specifically, (a) in FIG. 20 is a perspective view of the flow channel forming member, and (b) in FIG. 20 is a cross-sectional view of the flow channel forming member. (a) in FIG. 21 is a perspective view of the auxiliary flow channel forming member, and (b) in FIG. 21 is a cross-sectional view of the auxiliary flow channel forming member.

Referring to FIGS. 19 to 21, a concentrator according to another embodiment of the present disclosure will be described. A description of contents duplicated with the above-mentioned contents of contents to be described later will be omitted. However, the omitted contents should not be construed as limiting.

The nozzle coupling portion 220 according to another embodiment of the present disclosure may include a nozzle inserted portion 226 protruding from the inner circumferential surface of the nozzle 211 toward the outer circumferential surface of the auxiliary flow channel forming member 230. Furthermore, the auxiliary coupling portion 240 may include an auxiliary slit 247 defined through the outer circumferential surface of the auxiliary flow channel forming member 230.

The nozzle inserted portion 226 may be inserted into and coupled to the auxiliary slit 247. Furthermore, the nozzle inserted portion 226 may pass through the auxiliary slit 247 and be inserted into the auxiliary flow channel forming member 230. Accordingly, an end of the nozzle inserted portion 226 may be located inside the auxiliary flow channel forming member 230.

The nozzle inserted portion 226 may further include a separate coupling member fastened to the end thereof as the end thereof is located inside the auxiliary flow channel forming member 230, or may increase the force of coupling of the flow channel forming member 210 and the flow channel forming member 230 via a shape of the nozzle inserted portion 226. Furthermore, the nozzle inserted portion 226 may further include the separate coupling member fastened to the end thereof as the end thereof is located inside the auxiliary flow channel forming member 230, or may prevent gas flowing in the nozzle flow channel 280 from leaking out as much as possible via the shape of the nozzle inserted portion 226 and via the auxiliary slit 247.

Specifically, the nozzle inserted portion 226 may include a joint portion 2261 in contact with and coupled to the inner circumferential surface of the auxiliary slit 247. Furthermore, the nozzle inserted portion 226 may include a stepped portion 2263 protruding from the joint portion 2261 into the auxiliary flow channel forming member 230. Furthermore, the stepped portion 2263 may be coupled to the inner circumferential surface of the auxiliary flow channel forming member 230 so as to be in contact therewith.

Accordingly, the joint portion 2261 may come into contact with an inner circumferential surface of the auxiliary slit 247 to support the auxiliary flow channel forming member 230 in a state of being spaced apart from the flow channel forming member 210. Furthermore, the stepped portion 2263 may fix the auxiliary flow channel forming member 230 to the flow channel forming member 210.

As a result, the auxiliary flow channel forming member 230 may be inserted into the flow channel forming member 210 and may be easily fixed so as to be spaced apart from the flow channel forming member 210 by the nozzle inserted portion 226 and the auxiliary slit 247. That is, because the auxiliary flow channel forming member 230 can be coupled to the flow channel forming member 210 without the need for separate bolting, adhesives, or welding, the manufacturing process can be simplified. Furthermore, because the separate member or process for the fixing is omitted, the economic efficiency may be increased.

The nozzle inserted portion 226 may include a plurality of nozzle inserted portions along the inner circumferential surface of the nozzle 211. Furthermore, the auxiliary slit 247 may include a plurality of auxiliary slits along the outer circumferential surface of the auxiliary flow channel forming member 230 corresponding to the nozzle inserted portion 226. Specifically, the nozzle inserted portion 226 and the auxiliary slit 247 may be disposed symmetrically with respect to the aforementioned one direction C1. This is to avoid the interference with the flow guider 233 to be described later. Accordingly, the nozzle inserted portion 226 and the auxiliary slit 247 may respectively include the plurality of nozzle inserted portions and the plurality of auxiliary slits to increase the coupling force, and the internal space of the nozzle flow channel 280 may be efficiently utilized with efficient arrangement with the flow guider 233.

The flow guider 233 described above may be disposed along the outer circumferential surface of the auxiliary flow channel forming member 230. That is, the flow guider 233 may extend from the one end of the auxiliary flow channel forming member 230 facing the gas discharger 110 to the other end thereof facing the outside. Furthermore, the flow guider 233 may be disposed in parallel with the discharger 213. Furthermore, the diameter of the flow guider 233 may decrease as the distance from the gas discharger 110 increases. That is, the flow guider 233 may be formed in the thin wing shape.

Accordingly, the flow guider 233 may guide gas flowing through the nozzle flow channel 280 to the discharger 213. Thus, gas flowing through the nozzle flow channel 280 may be stably guided toward the discharger 213 via the flow guider 233. Furthermore, the flow guider 233 may be disposed in parallel with the discharger 213 to give the directionality of coupling when the auxiliary flow channel forming member 230 is inserted into the flow channel forming member 210.

Furthermore, the number of nozzle inserted portions 226 and the number of auxiliary slits 247 may be equal to or greater than four to provide the greater coupling force, and the nozzle inserted portion 226 and the auxiliary slit 247 may be disposed symmetrically with respect to the other direction C2 described above. However, as described above, the discharger 213 may extend into the nozzle 211. Accordingly, an angle formed by the nozzle inserted portion 226 based on the imaginary line F extending in the other direction C2 may be limited to be within a certain range. Furthermore, an angle formed by the auxiliary slit 247 based on the imaginary line F extending in the other direction C2 may be limited to be within a certain range. For example, the angle may be limited to be equal to or smaller than 45 degrees. As a result, the resistance of the gas flow concentrated in the discharger 213 may be prevented from being generated as much as possible.

In one example, to support the coupling of the flow channel forming member 210 and the auxiliary flow channel forming member 230, the concentrator 200 according to another embodiment of the present disclosure may further include a flow channel forming support 250.

FIG. 22 is a view showing a flow channel forming support of a concentrator according to another embodiment of the present disclosure. Specifically, (a) in FIG. 22 is a perspective view of the flow channel forming support, and (b) in FIG. 22 is a cross-sectional view of the flow channel forming support.

Referring to FIGS. 21 and 22, the concentrator 200 according to another embodiment of the present disclosure may further include the flow channel forming support 250. The flow channel forming support 250 may be disposed inside the auxiliary flow channel forming member 230. Furthermore, the flow channel forming support 250 may be coupled to the auxiliary flow channel forming member 230 to support the auxiliary flow channel forming member 230.

The flow channel forming support 250 may include a support recession 251 defined by being recessed in an outer circumferential surface of the flow channel forming support 250. The support recession 251 may be formed in a shape corresponding to the end of the nozzle inserted portion 226 located inside the auxiliary flow channel forming member 230. That is, the support recession 251 may include a stepped corresponding portion 2511 corresponding to the stepped portion 2263.

Accordingly, the nozzle inserted portion 226 may be inserted into and coupled to the support recession 251 through the auxiliary slit 247. As a result, the flow channel forming support 250 may support the coupling of the flow channel forming member 210 and the flow channel forming support 250. Furthermore, the flow channel forming member 210 and the flow channel forming support 250 may be easily fixed. Furthermore, the flow channel forming support 250 may prevent gas flowing through the auxiliary slit 247 as much as possible.

Furthermore, the auxiliary flow channel forming member 230 may include an auxiliary protruding coupling portion 235 protruding from the center of the auxiliary flow channel forming member 230 toward the gas discharger 110. The flow channel forming support 250 may include a support recessed coupling portion 253 defined by being recessed in a shape corresponding to the auxiliary protruding coupling portion 235 at the center of the flow channel forming support 250. The auxiliary protruding coupling portion 235 may be inserted into and coupled to the support recessed coupling portion 253.

As a result, the flow channel forming support 250 may more strongly support the coupling of the flow channel forming member 210 and the flow channel forming support 250. Furthermore, the flow channel forming member 210 and the flow channel forming support 250 may be fixed more easily.

In one example, as described above, the gas discharger 110 may include the center hole 115 defined at the center of the gas discharger 110 to discharge gas. Furthermore, the gas discharger 110 may include the side hole 113 defined in the ring shape surrounding the center hole 115 and through which gas is discharged. Gas passing through the center hole 115 and the side hole 113 may entirely be guided to the nozzle flow channel 280 and discharged to the outside. However, gas that has passed through the center hole 115 may be guided into the auxiliary flow channel forming member 230 to form the vortex. Furthermore, the gas that has passed through the center hole 115 may pressurize the inside of the auxiliary flow channel forming member 230 in the direction away from the gas discharger to separate the concentrator 200 from the main body 100.

Accordingly, in one example, the auxiliary flow channel forming member 230 may have an auxiliary flow channel communication hole (not shown) at the center. Furthermore, the flow channel forming support 250 may have a flow channel support communication hole (not shown) at the center. The auxiliary flow channel communication hole and the flow channel support communication hole may be in communication with each other when the auxiliary protruding coupling portion 235 is inserted into and coupled to the support recessed coupling portion 253. Accordingly, the auxiliary flow channel communication hole and the flow channel support communication hole may allow the inside of the flow channel forming support 250 and the discharger 213 to be in communication with each other. Further, gas flowing into the flow channel forming support 250 from the center hole 115 may be guided to the discharger 213 via the auxiliary flow channel communication hole and the flow channel support communication hole.

In other words, the internal flow channel 285 may be formed inside the flow channel forming support 250. The internal flow channel 285 may be in communication with the discharger 213 via the auxiliary flow channel communication hole and the flow channel support communication hole. Gas that has passed through the internal flow channel 285 may be guided to the discharger 213 via the auxiliary flow channel communication hole and the flow channel support communication hole.

Thus, the formation of the vortex of gas flowing into the flow channel forming support 250 may be prevented as much as possible. Furthermore, the separation of the concentrator 200 from the main body 100 by gas introduced into the flow channel forming support 250 may be prevented as much as possible.

Further, as the gas flow that has passed through the internal flow channel 285 and the nozzle flow channel 280 is integrated in the discharger flow channel 290, the concentration of gas may be facilitated. That is, concentrated gas may be provided to the user. Furthermore, the internal flow channel 285 and the nozzle flow channel 280 may have the different shapes, cross-sectional areas, lengths, and the like. That is, the gas flow of the various characteristics may be provided to the user. The user may receive the three-dimensional gas flow via the nozzle flow channel 280 and the internal flow channel 285.

FIG. 23 is a view showing a process of coupling a flow channel forming member and an auxiliary flow channel forming member of a concentrator to each other according to another embodiment of the present disclosure. FIG. 24 is a view showing a process of coupling a flow channel forming support to a flow channel forming member and an auxiliary flow channel forming member of a concentrator according to another embodiment of the present disclosure.

Specifically, (a) in FIG. 23 shows a state in which the flow channel forming member and the auxiliary flow channel forming member are separated from each other, and (b) in FIG. 23 shows a state in which the flow channel forming member and the auxiliary flow channel forming member are coupled to each other. (a) in FIG. 24 shows a state in which the auxiliary flow channel forming member and the flow channel forming support are separated from each other, and (b) in FIG. 24 shows a state in which the auxiliary flow channel forming member and the flow channel forming support are coupled to each other.

Referring to FIGS. 23 and 24, the process of coupling the flow channel forming member and the auxiliary flow channel forming member to each other according to another embodiment of the present disclosure will be described. Furthermore, a process of further coupling the flow channel forming support in the state in which the flow channel forming member and the auxiliary flow channel forming member are coupled to each other will be described.

As the auxiliary flow channel forming member 230 is inserted into the flow channel forming member 210, the nozzle inserted portion 226 may come closer to the auxiliary slit 247. Furthermore, the nozzle inserted portion 226 may be in contact with the auxiliary slit 247. The stepped portion 2263 may be elastically deformed by the inner circumferential surface of the auxiliary slit 247. That is, the stepped portion 2263 may be compressed in a direction away from the center of the nozzle 211. With the stepped portion 2263 compressed, the nozzle inserted portion 226 may be inserted into the auxiliary slit 247. When the stepped portion 2263 is located inside the auxiliary flow channel forming member 230, the stepped portion 2263 may be restored to an original state thereof. In this regard, the joint portion 2261 may come into contact with the inner circumferential surface of the auxiliary slit 247, and the stepped portion 2263 may come into contact with the inner circumferential surface of the auxiliary flow channel forming member 230 to complete the coupling.

As the flow channel forming support 250 is inserted into the auxiliary flow channel forming member 230, the support recession 251 may come closer to the nozzle inserted portion 226. Furthermore, a portion of the nozzle inserted portion 226 positioned inside the flow channel forming member 210 may come into contact with the support recession 251. The stepped portion 2263 may be elastically deformed by the inner circumferential surface of the support recession 251. That is, the stepped portion 2263 may be compressed in the direction away from the center of the nozzle 211. With the stepped portion 2263 compressed, the nozzle inserted portion 226 may be inserted into the support recession 251. When the stepped portion 2263 is located in a portion corresponding to the stepped portion of the support recession 251, the stepped portion 2263 may be restored to the original state thereof. In this regard, the stepped portion 2263 may come into contact with the inner circumferential surface of the support recession 251 to complete the coupling.

In one example, the concentrator according to another embodiment of the present disclosure may not have the cover. That is, the flow channel forming member 210 may be located at the outermost side of the concentrator 200. This is to provide a more concentrated gas flow to the user by maximizing flow cross-sectional areas of the nozzle flow channel 280 and the discharger flow channel 290 formed between the flow channel forming member 210 and the auxiliary flow channel forming member 230.

However, in this case, the user may come into contact with the heated flow channel forming member 210, increasing the risk of injury such as the burning. Accordingly, the flow channel forming member 210 may be subjected to heat-insulating coating. Furthermore, the flow channel forming member 210 may be made of a heat-insulating material.

Although representative embodiments of the present disclosure have been described in detail above, those of ordinary skill in the technical field to which the present disclosure belongs will understand that various modifications are possible with respect to the above-described embodiment without departing from the scope of the present disclosure. Therefore, the scope of the present disclosure should not be limited to the described embodiment, and should be defined not only by the claims described below, but also by these claims and equivalents thereof.

What is claimed is:

1. A hair dryer, comprising:

a main body having a gas discharger configured to discharge gas;

a handle connected to the main body; and a concentrator detachably coupled to the main body, the concentrator being configured to receive gas discharged from the gas discharger and discharge gas to outside, the concentrator including:

a flow channel forming member including a nozzle whose diameter decreases as a distance from the gas discharger increases, wherein the nozzle is configured to receive gas discharged from the gas discharger;

an auxiliary flow channel forming member disposed inside the nozzle, a nozzle flow channel between the nozzle and the auxiliary flow channel forming member;

a nozzle coupling portion disposed on an inner circumferential surface of the nozzle and coupled to the auxiliary flow channel forming member; and an auxiliary coupling portion disposed on an outer circumferential surface of the auxiliary flow channel forming member and coupled to the nozzle coupling portion, wherein the nozzle coupling portion and the auxiliary coupling portion are located in the nozzle flow channel, space apart the flow channel forming member and the auxiliary flow channel forming member, and fix the auxiliary flow channel forming member to the flow channel forming member.

2. The hair dryer of claim 1, wherein the nozzle coupling portion includes a plurality of nozzle extensions arranged along a circumferential direction of the nozzle and extending from the inner circumferential surface of the nozzle toward the outer circumferential surface of the auxiliary flow channel forming member, wherein the auxiliary coupling portion includes a plurality of auxiliary hooks arranged along a circumferential direction of the auxiliary flow channel forming member, and wherein each auxiliary hook has a first end positioned closer to the gas discharger than each nozzle extension and a second end hook-coupled to each nozzle extension.

3. The hair dryer of claim 2, wherein the nozzle coupling portion further includes a plurality of nozzle recessions, wherein each nozzle recession is spaced apart from each nozzle extension and is recessed from the inner circumferential surface of the nozzle, wherein the auxiliary coupling portion further includes a plurality of auxiliary protrusions disposed at locations corresponding to the plurality of nozzle recessions and protruding from the outer circumferential surface of the auxiliary flow channel forming member, and wherein each nozzle recession is located farther from the gas discharger than each nozzle extension, and each auxiliary protrusion is inserted into and coupled to a respective nozzle recession among the plurality of nozzle recessions.

4. The hair dryer of claim 2, wherein the nozzle coupling portion further includes a plurality of nozzle extension recessions, wherein each nozzle extension recession extends from each nozzle extension and is recessed from the inner circumferential surface of the nozzle, and wherein each nozzle extension recession accommodates the second end of a respective auxiliary hook among the plurality of auxiliary hooks.

5. The hair dryer of claim 2, wherein the concentrator further includes:

a cover having the flow channel forming member disposed therein; and a closing portion extending from an outer circumferential surface of the nozzle toward an inner circumferential surface of the cover, and wherein the closing portion is disposed at an end of the nozzle facing the gas discharger and is coupled to the cover to shield a space between the nozzle and the cover.

6. The hair dryer of claim 5, wherein the flow channel forming member further includes:

a magnetic body receiving portion being a surface of the closing portion facing the gas discharger that is recessed; and a magnetic body received in the magnetic body receiving portion to couple the concentrator to the main body.

7. The hair dryer of claim 6, wherein the flow channel forming member further includes:

a discharger extending from the nozzle to guide gas from the nozzle to the outside; and a discharge guider protruding from an outer circumferential surface of the discharger, wherein the cover further includes:

a nozzle cover formed in a shape corresponding to the nozzle, the nozzle being disposed in the nozzle cover;

a discharger cover formed in a shape corresponding to the discharger, the discharger being disposed in the discharger cover; and a cover protruding guider protruding from an inner circumferential surface of the discharger cover and in contact with the discharge guider, and wherein the discharger is in contact with the discharge guider and the cover protruding guider.

8. The hair dryer of claim 7, wherein the auxiliary flow channel forming member further includes a communication hole at a center of the auxiliary flow channel forming member, the communication hole allowing an inside of the auxiliary flow channel forming member to be in communication with the discharger, wherein the gas discharger includes:

a center hole at a center of the gas discharger for discharging gas therethrough; and a side hole defined in a ring shape surrounding the center hole to discharge gas therethrough, and wherein the communication hole guides gas flowing into the auxiliary flow channel forming member from the center hole to the discharger.

9. The hair dryer of claim 5, wherein the cover includes a plurality of cover protrusions arranged along a circumferential direction of the cover, wherein each cover protrusion protrudes from the inner circumferential surface of the cover toward the outer circumferential surface of the nozzle, wherein the closing portion includes a plurality of closing hooks arranged along a circumferential direction of the closing portion, and wherein each closing hook is coupled to a respective cover protrusion among the plurality of cover protrusions to space apart the inner circumferential surface of the cover and the flow channel forming member and to fix the flow channel forming member to the cover.

10. The hair dryer of claim 1, wherein the nozzle coupling portion includes a plurality of nozzle protrusions arranged along a circumferential direction of the nozzle and protruding from the inner circumferential surface of the nozzle, wherein the auxiliary coupling portion includes a plurality of auxiliary recessions arranged along a circumferential direction of the auxiliary flow channel forming member and recessed in the outer circumferential surface of the auxiliary flow channel forming member, and wherein each nozzle protrusion is coupled to a respective auxiliary recession among the plurality of auxiliary recessions.

11. The hair dryer of claim 10, wherein the nozzle coupling portion further includes a central coupling portion extending from a center of the nozzle toward the gas discharger, wherein the auxiliary coupling portion further includes a central recession recessed at a center of the auxiliary flow channel forming member, and wherein the central coupling portion is coupled to the central recession.

12. The hair dryer of claim 11, wherein the flow channel forming member further includes a discharger extending from the nozzle to guide gas from the nozzle to the outside, wherein the central coupling portion includes a central coupling communication hole at a center of the central coupling portion, wherein the central recession includes a central recession communication hole at a center of the central recession, wherein the gas discharger includes:

a center hole defined at a center of the gas discharger to discharge gas therethrough; and a side hole defined in a ring shape surrounding the center hole to discharge gas therethrough, and wherein the central recession communication hole and the central coupling communication hole allow an inside of the auxiliary flow channel forming member and the discharger to be in communication with each other to guide gas flowing into the auxiliary flow channel forming member from the center hole to the discharger.

13. The hair dryer of claim 12, wherein the central coupling portion further includes:

a central extension extending from a location where the nozzle and the discharger come into contact with each other; and a central inserted portion having a larger diameter than the central extension, the central inserted portion extending from the central extension, and wherein the central inserted portion is coupled to the central recession.

14. The hair dryer of claim 13, wherein the auxiliary flow channel forming member further includes a flow guider extending along the outer circumferential surface of the auxiliary flow channel forming member to surround the central recession, wherein the flow guider has a diameter that decreases as a distance from the gas discharger increases, wherein the flow guider is coupled to the central extension, and wherein the flow guider is disposed in parallel with the discharger to guide gas flowing through the nozzle flow channel to the discharger.

15. The hair dryer of claim 12, wherein the concentrator further includes:

a cover including:

a nozzle cover having the nozzle disposed therein; and a discharger cover having the discharger disposed therein;

a closing portion extending from an outer circumferential surface of the nozzle toward an inner circumferential surface of the cover, the closing portion being coupled to the cover;

a plurality of cover receiving portions arranged along a circumferential direction of the nozzle cover, each cover receiving portion having a surface recessed to be coupled to the flow channel forming member; and a plurality of closing coupling portions arranged along a circumferential direction of the closing portion, wherein each closing coupling portion extends toward a respective cover receiving portion among the plurality of cover receiving portions, and wherein each closing coupling portion has an end protruding and inserted into the respective cover receiving portion to space apart the cover and the flow channel forming member from each other and to fix the flow channel forming member to the cover.

16. The hair dryer of claim 15, wherein the cover further includes a cover recessed guider recessed from an inner circumferential surface of the discharger cover and extending along an insertion direction of the discharger, and wherein the flow channel forming member further includes a discharge guide protruding from an outer circumferential surface of the discharger toward the inner circumferential surface of the discharger cover, the flow channel forming member being inserted into the cover recessed guider.

17. The hair dryer of claim 1, wherein the nozzle coupling portion includes a plurality of nozzle inserted portions protruding from the inner circumferential surface of the nozzle, wherein the auxiliary coupling portion includes a plurality of auxiliary slits along the outer circumferential surface of the auxiliary flow channel forming member, wherein each nozzle inserted portion is inserted into and coupled to a respective auxiliary slit among the plurality of auxiliary slits, and wherein an end of each nozzle inserted portion is positioned inside the auxiliary flow channel forming member.

18. The hair dryer of claim 17, wherein each nozzle inserted portion includes:

a joint portion coupled to an inner circumferential surface of the respective auxiliary slit; and a stepped portion protruding from the joint portion inwardly of the auxiliary flow channel forming member, and wherein the stepped portion is coupled to and in contact with an inner circumferential surface of the auxiliary flow channel forming member.

19. The hair dryer of claim 17, wherein the concentrator further includes a flow channel forming support disposed inside and coupled to the auxiliary flow channel forming member to support the auxiliary flow channel forming member, wherein the flow channel forming support includes a plurality of support recessions recessed from an outer circumferential surface of the flow channel forming support, the flow channel forming support having a shape corresponding to an end of the plurality of nozzle inserted portions, and wherein each nozzle inserted portion passes through the respective auxiliary slit and is coupled to a respective support recession among the plurality of support recessions.

20. The hair dryer of claim 19, wherein the auxiliary flow channel forming member further includes an auxiliary protruding coupling portion protruding from a center of the auxiliary flow channel forming member toward the gas discharger, wherein the flow channel forming support further includes a support recessed coupling portion recessed at a center of the flow channel forming support in a shape corresponding to the auxiliary protruding coupling portion, and wherein the auxiliary protruding coupling portion is coupled to the support recessed coupling portion.

* * * * *